US007158730B2

(12) United States Patent
Watanabe et al.

(10) Patent No.: US 7,158,730 B2
(45) Date of Patent: Jan. 2, 2007

(54) IMAGE FORMING APPARATUS, PROCESS CARTRIDGE, DEVELOPING UNIT, AND IMAGE FORMING METHOD

(75) Inventors: Kazuhito Watanabe, Kanagawa (JP); Satoshi Narumi, Kanagawa (JP); Shinji Tamaki, Tokyo (JP); Satoshi Hatori, Kanagawa (JP); Tsutomu Katoh, Kanagawa (JP); Haruji Mizuishi, Tokyo (JP); Tetsuroh Tanigawa, Kanagawa (JP); Misao Tanzawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/912,207

(22) Filed: Aug. 6, 2004

(65) Prior Publication Data

US 2005/0063713 A1 Mar. 24, 2005

(30) Foreign Application Priority Data

Aug. 7, 2003 (JP) ..... 2003-289271
Aug. 7, 2003 (JP) ..... 2003-289337
Aug. 7, 2003 (JP) ..... 2003-289369

(51) Int. Cl.
*G03G 15/00* (2006.01)
*G03G 15/08* (2006.01)
*G03G 15/04* (2006.01)

(52) U.S. Cl. ..... 399/12; 399/27; 399/28; 399/119; 399/120; 399/259

(58) Field of Classification Search ..... 399/12, 399/24, 27, 28, 29, 119, 120, 252, 255, 258, 399/259; 430/106.1, 110.4
See application file for complete search history.

(56) References Cited

U.S. PATENT DOCUMENTS

| | | | |
|---|---|---|---|
| 4,768,062 | A | 8/1988 | Tanzawa et al. |
| 4,862,209 | A | 8/1989 | Sakamoto et al. |
| 4,862,212 | A | 8/1989 | Tanzawa et al. |
| 4,885,466 | A | 12/1989 | Koichi et al. |
| 4,908,661 | A | 3/1990 | Iwata et al. |
| 4,931,840 | A | 6/1990 | Tanzawa et al. |
| 5,008,711 | A | 4/1991 | Sakamoto et al. |
| 5,019,867 | A | 5/1991 | Yamakawa et al. |
| 5,166,739 | A | 11/1992 | Katsuki et al. |
| 5,597,673 | A | 1/1997 | Watanabe et al. |
| 5,747,210 | A | 5/1998 | Emoto et al. |
| 5,784,669 | A | 7/1998 | Miura et al. |
| 5,812,919 | A | 9/1998 | Takano et al. |
| 5,857,132 | A | 1/1999 | Mizuishi et al. |
| 5,887,224 | A | 3/1999 | Mizuishi et al. |
| 5,913,092 | A | 6/1999 | Bisaiji et al. |
| 5,915,155 | A | 6/1999 | Shoji et al. |
| 5,950,062 | A | 9/1999 | Yahata et al. |

(Continued)

FOREIGN PATENT DOCUMENTS

JP 11-231759 8/1998

(Continued)

*Primary Examiner*—Hoang Ngo
(74) *Attorney, Agent, or Firm*—Oblon, Spivak, McClelland, Maier & Neustadt, P.C.

(57) ABSTRACT

A carrier and a dummy toner are stored in a developing unit of a process cartridge in a brand new status. A plurality of process cartridges corresponding to a plurality of color toners is used in common. The color toners are respectively supplied to the developing unit from toner supply units after the process cartridges in the brand new status are installed in installation sections in a main unit of an image forming apparatus.

120 Claims, 7 Drawing Sheets

U.S. PATENT DOCUMENTS 6,055,388 A 4/2000 Watanabe et al.
6,085,062 A 7/2000 Mizuishi et al.
6,108,511 A 8/2000 Kutsuwada et al.
6,122,469 A 9/2000 Miura et al.
6,125,243 A 9/2000 Shoji et al.
6,128,449 A 10/2000 Zenba et al.
6,141,521 A 10/2000 Yuuki et al.
6,144,811 A 11/2000 Ohori et al.
6,144,822 A 11/2000 Yamaguchi et al.
6,148,161 A 11/2000 Usui et al.
6,160,969 A 12/2000 Ishigaki et al.
6,198,895 B1 3/2001 Tsuda et al.
6,266,501 B1 7/2001 Mizuishi et al.
6,337,957 B1 1/2002 Tamaki et al.
6,403,275 B1 6/2002 Kuramoto et al.
6,465,144 B1 * 10/2002 Hashimoto et al. ..... 430/106.1
6,522,855 B1 2/2003 Katoh et al.
6,553,202 B1 4/2003 Tamaki et al.
6,597,881 B1 7/2003 Hatori et al.
6,611,672 B1 8/2003 Aoki et al.
6,628,903 B1 9/2003 Ohori et al.
6,660,443 B1 12/2003 Sugiyama et al.
6,756,175 B1 6/2004 Emoto et al.
6,768,881 B1 7/2004 Hatori
2003/0077536 A1 4/2003 Yamashita et al.
2003/0096185 A1 5/2003 Yamashita et al.
2003/0185585 A1 10/2003 Kimura et al.
2003/0231905 A1 12/2003 Uchida et al.
2004/0009421 A1 1/2004 Mizuishi
2004/0071475 A1 4/2004 Ohori et al.
2004/0076900 A1 4/2004 Sugiyama et al.
2004/0096239 A1 5/2004 Hosokawa et al.
2004/0101328 A1 5/2004 Kimura et al.
2004/0131381 A1 7/2004 Kawasumi et al.
2004/0146309 A1 7/2004 Shu et al.
2004/0170446 A1 9/2004 Nagashima et al.
2004/0184841 A1 9/2004 Tsuda et al.
2004/0213600 A1 10/2004 Watanabe et al.

FOREIGN PATENT DOCUMENTS

JP 2942042 6/1999
JP 2003-84534 3/2003

* cited by examiner

IMAGE FORMING APPARATUS, PROCESS CARTRIDGE, DEVELOPING UNIT, AND IMAGE FORMING METHOD

CROSS-REFERENCE TO RELATED APPLICATIONS

The present document incorporates by reference the entire contents of Japanese priority documents, 2003-289271 filed in Japan on Aug. 7, 2003, 2003-289337 filed in Japan on Aug. 7, 2003 and 2003-289369 filed in Japan on Aug. 7, 2003.

BACKGROUND OF THE INVENTION

1) Field of the Invention

The present invention relates to an image forming apparatus using an electrographic method, such as a copier, a printer, a facsimile, or a multifunction product thereof, which forms an image of multiple colors, such as a color image, a process cartridge and a developing unit installed therein, and an image forming method.

2) Description of the Related Art

Conventionally, in a color image forming apparatus such as a color copier, process cartridges (or developing unit) corresponding to toners of multiple colors (yellow, magenta, cyan, and black) are detachably installed in an image forming apparatus main unit. These process cartridges (or developing unit) are appropriately replaced by a new one, as the process cartridge mechanically wears out.

Specifically, in a developing unit in a new process cartridge, for example, (1) a two-component developer including a carrier and a toner of any one color of yellow, magenta, cyan, and black, or (2) a one-component developer including a toner of any one color of yellow, magenta, cyan, and black is stored beforehand in a space completely isolated by a sealing member.

After the sealing member in the developing unit in the new process cartridge is taken away, four process cartridges are respectively installed in the respective installation sections in the image forming apparatus main unit. Thereafter, when a photosensitive drum (an image carrier) in the process cartridge deteriorates, or the one-component developer in the cartridge has been consumed, to reach the end of the service life, with the operation of the image forming apparatus, the existing process cartridge installed in the image forming apparatus main unit is taken out by an operator such as a user or a maintenance person. A new process cartridge is then installed newly in the apparatus main unit.

In the image forming apparatus in which the process cartridges (or developing unit) are detachably installed, it is necessary that the respective process cartridges are installed precisely in the corresponding installation section. That is, an installation error such that a process cartridge of a certain color is installed in an installation section of a different color should not be made by the operator.

For this purpose, in the image forming apparatus, such a technique is mainly used that a shape difference is provided in the four process cartridges and the installation sections in the apparatus main unit respectively corresponding to the four process cartridges, to ensure the incompatibility (For example, see Japanese Patent Application Laid-open No. 2003-84534).

The sealing member installed in the developing unit in the process cartridge is for preventing the toner stored in the developing unit from scattering from the process cartridge (For example, see Japanese Patent Application Laid-open No. H11-231759).

SUMMARY OF THE INVENTION

It is an object of the present invention to solve at least the above problems in the conventional technology.

An image forming apparatus according to one aspect of the present invention includes a plurality of process cartridges that integrally holds an image carrier and a developing unit that develops an electrostatic latent image formed on the image carrier to form a toner image, the process cartridges being compatible with each other; a plurality of installation sections in which the process cartridges are detachably installed, respectively; a carrier and a dummy toner stored in the developing unit of each of the process cartridges in a brand-new status to be installed in the installation sections; a plurality of toner supply units that supply a toner of one color from among a plurality of color toners, respectively, to the developing units of the process cartridges installed in the installation sections; and a transfer unit that transfers the toner image formed on the image carrier onto a medium to form an image. The dummy toner is formed such that the dummy toner less contributes to formation of the image on the medium than the color toners. Each of the color toners is supplied to the developing unit from the toner supply units after the process cartridges in the brand new status are installed in the installation sections.

An image forming apparatus according to another aspect of the present invention includes a plurality of developing units that develops an electrostatic latent image formed on an image carrier to form a toner image, the developing units being compatible with each other; a plurality of installation sections in which the developing units are detachably installed, respectively; a carrier and a dummy toner stored in the developing unit of each of the process cartridges in a brand-new status to be installed in the installation sections; a plurality of toner supply units that supply a toner of one color from among a plurality of color toners, respectively, to the developing units of the process cartridges installed in the installation sections; and a transfer unit that transfers the toner image formed on the image carrier onto a medium to form an image. The dummy toner is formed such that the dummy toner less contributes to formation of the image on the medium than the color toners. Each of the color toners is supplied to the developing unit from the toner supply units after the process cartridges in the brand new status are installed in the installation sections.

A process cartridge according to still another aspect of the present invention integrally holds an image carrier and a developing unit that develops an electrostatic latent image formed on the image carrier to form a toner image. In a brand new status, the developing unit stores a carrier and a dummy toner inside, the dummy toner being different from toners forming the toner image.

A developing unit according to still another aspect of the present invention develops an electrostatic latent image formed on an image carrier to form a toner image. In a brand new status, the developing unit stores a carrier and a dummy toner inside, the dummy toner being different from toners forming the toner image.

An image forming method according to still another aspect of the present invention includes installing a process cartridge that integrally holds an image carrier, and a developing unit that develops an electrostatic latent image formed on the image carrier to form a toner image, and stores a carrier and a dummy toner in the developing unit of the process cartridge in a brand new status, in one of a plurality of installation sections in a main unit of an image forming apparatus in which a plurality of process cartridges are detachably installed; supplying a toner of one color from among a plurality of color toners to the developing unit from one of a plurality of toner supply units in the main unit, after the installing; and transferring the toner image formed on the image carrier onto a medium to form an image. The dummy toner is formed such that the dummy toner less contributes to formation of the image on the medium than the color toners.

An image forming method according to still another aspect of the present invention includes installing a developing unit that develops an electrostatic latent image formed on an image carrier to form a toner image, and stores a carrier and a dummy toner in a brand new status, in one of a plurality of installation sections in a main unit of an image forming apparatus in which a plurality of developing unites are detachably installed; supplying a toner of one color from among a plurality of color toners to the developing unit from one of a plurality of toner supply units in the main unit, after the installing; and transferring the toner image formed on the image carrier onto a medium to form an image. The dummy toner is formed such that the dummy toner less contributes to formation of the image on the medium than the color toners.

An image forming apparatus according to still another aspect of the present invention includes a plurality of process cartridges that integrally holds an image carrier and a developing unit that develops an electrostatic latent image formed on the image carrier to form a toner image, the process cartridges being compatible with each other; a plurality of installation sections in which the process cartridges are detachably installed, respectively; a carrier stored in the developing unit of each of the process cartridges in a brand-new status to be installed in the installation sections; and a plurality of toner supply units that supply a toner of one color from among a plurality of color toners, respectively, to the developing units of the process cartridges installed in the installation sections. Each of the color toners is supplied to the developing unit from the toner supply units after the process cartridges in the brand new status are installed in the installation sections.

An image forming apparatus according to still another aspect of the present invention includes a plurality of developing units that develops an electrostatic latent image formed on an image carrier to form a toner image, the developing units being compatible with each other; a plurality of installation sections in which the developing units are detachably installed, respectively; a carrier stored in the developing unit in a brand new status to be installed in the installation sections; and a plurality of toner supply units that supply a toner of one color from among a plurality of color toners, respectively, to the developing units installed in the installation sections. Each of the color toners is supplied to the developing unit from the toner supply units after the process cartridges in the brand new status are installed in the installation sections.

A process cartridge according to still another aspect of the present invention integrally holds an image carrier and a developing unit that develops an electrostatic latent image formed on the image carrier to form a toner image. In a brand new status, the developing unit only stores a carrier inside.

A developing unit according to still another aspect of the present invention develops an electrostatic latent image formed on an image carrier. In a brand new status, the developing unit only stores a carrier inside.

An image forming method according to still another aspect of the present invention includes installing a process cartridge that integrally holds an image carrier and a developing unit that develops an electrostatic latent image formed on the image carrier, and stores only a carrier in the developing unit of the process cartridge in a brand new status, in one of a plurality of installation sections in a main unit of an image forming apparatus in which a plurality of process cartridges are detachably installed; and supplying a toner of one color from among a plurality of color toners to the developing unit from one of a plurality of toner supply units in the main unit, after the installing.

An image forming method according to still another aspect of the present invention includes installing a developing unit that develops an electrostatic latent image formed on an image carrier to form a toner image, and stores only a carrier in a brand new status, in one of a plurality of installation sections in a main unit of an image forming apparatus in which a plurality of developing unites are detachably installed; and supplying a toner of one color from among a plurality of color toners to the developing unit from one of a plurality of toner supply units in the main unit, after the installing.

An image forming apparatus according to still another aspect of the present invention includes a plurality of process cartridges that integrally holds an image carrier and a developing unit that develops an electrostatic latent image formed on the image carrier to form a toner image, the process cartridges being compatible with each other; a plurality of installation sections in which the process cartridges are detachably installed, respectively; and a plurality of toner supply units that supply a toner of one color from among a plurality of color toners, respectively, to the developing units of the process cartridges installed in the installation sections. The process cartridges in a brand new status installed in the installation sections do not store any developer containing the color toners. The color toners are respectively supplied from the toner supply units to the developing unit after the process cartridges in the brand new status are respectively installed in the installation sections.

An image forming apparatus according to still another aspect of the present invention includes a plurality of developing units that develops an electrostatic latent image formed on an image carrier to form a toner image, the developing units being compatible with each other; a plurality of installation sections in which the developing units are detachably installed, respectively; and a plurality of toner supply units that supply a toner of one color from among a plurality of color toners, respectively, to the developing units of the process cartridges installed in the installation sections. The process cartridges in a brand new status installed in the installation sections do not store any developer containing the color toners. The color toners are respectively supplied from the toner supply units to the developing unit after the process cartridges in the brand new status are respectively installed in the installation sections.

A process cartridge according to still another aspect of the present invention integrally holds an image carrier and a developing unit that develops an electrostatic latent image formed on the image carrier to form a toner image. In a brand new status, the cartridge does not contain any developer inside.

A developing unit according to still another aspect of the present invention develops an electrostatic latent image formed on an image carrier. In a brand new status, the developing unit does not store any developer inside.

An image forming method according to still another aspect of the present invention includes installing a process cartridge that integrally holds an image carrier and a developing unit that develops an electrostatic latent image formed on the image carrier, and stores no developer in the process cartridge in a brand new status, in one of a plurality of installation sections in a main unit of an image forming apparatus in which a plurality of process cartridges are detachably installed; and supplying a toner of one color from among a plurality of color toners to the developing unit from one of a plurality of toner supply units in the main unit, after the installing.

An image forming method according to still anther aspect of the present invention includes installing a developing unit that develops an electrostatic latent image formed on an image carrier, stores no developer in the process cartridge in a brand new status, in one of a plurality of installation sections in a main unit of an image forming apparatus in which a plurality of process cartridges are detachably installed; and supplying a toner of one color from among a plurality of color toners to the developing unit from one of a plurality of toner supply units in the main unit, after the installing.

The other objects, features, and advantages of the present invention are specifically set forth in or will become apparent from the following detailed description of the invention when read in conjunction with the accompanying drawings.

DETAILED DESCRIPTION

Figure 1:
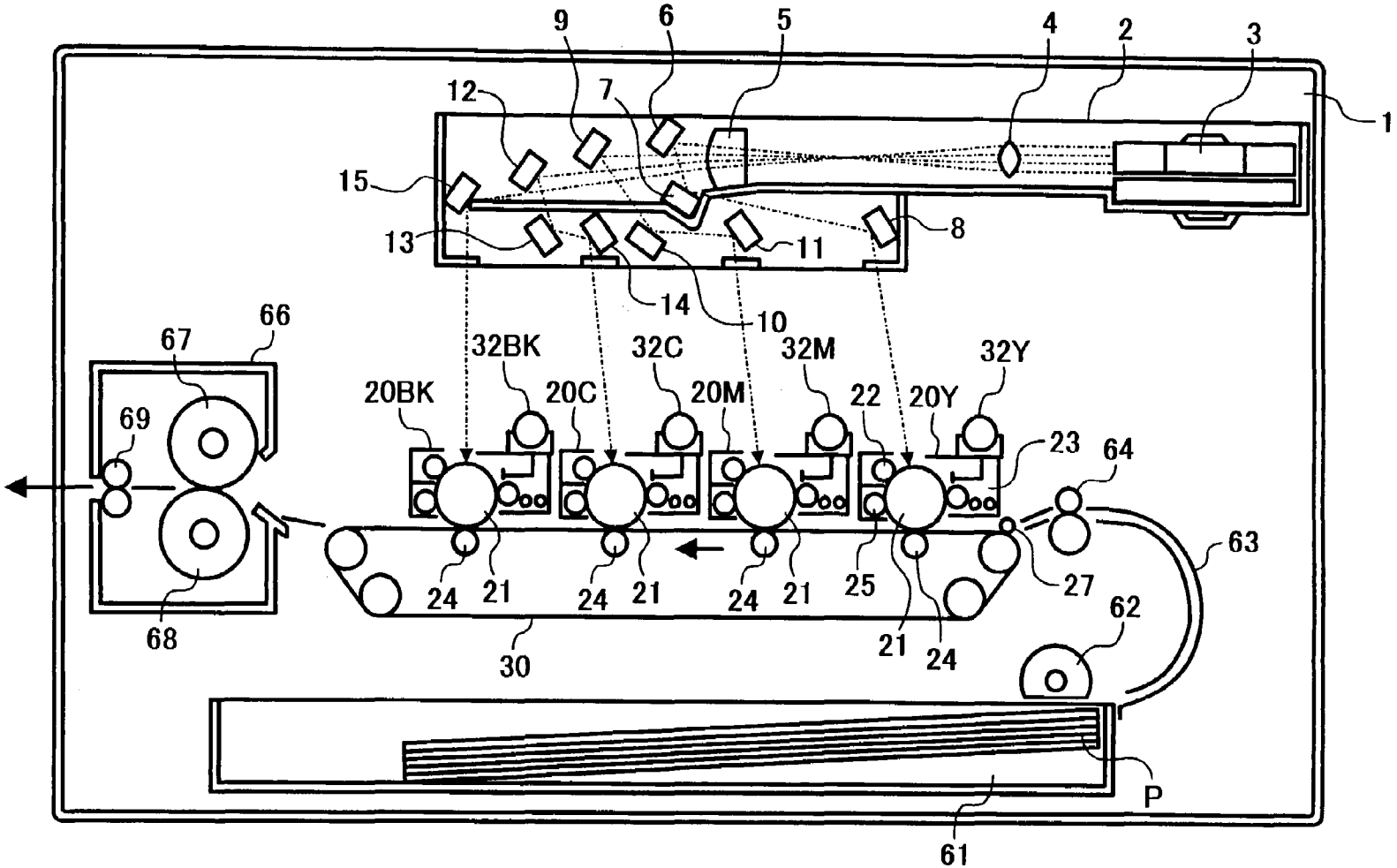
FIG. 1 is a block diagram of an image forming apparatus according to a first embodiment of the present invention.

Exemplary embodiments of an image forming apparatus, a process cartridge, a developing unit, and an image forming method according to the present invention will be explained below in detail with reference to the accompanying drawings. In the drawings, like or corresponding parts are designated by like reference signs, and redundant explanations will be simplified or omitted.

FIG. 1 is a block diagram of the whole image forming apparatus according to a first embodiment of the present invention. Reference sign 1 denotes the apparatus main unit of a color laser printer as the image forming apparatus, 2 denotes an optical unit that emits laser beams based on the image information, 20Y, 20M, 20C, and 20BK denote process cartridges installed in installation sections corresponding to the respective colors (yellow, magenta, cyan, and black), 21 denotes a photosensitive drum as an image carrier, respectively housed in the respective process cartridges 20Y, 20M, 20C, and 20BK, 22 denotes a charging unit 22 that charges the surface of the photosensitive drum 21, 23 denotes a developing unit that develops an electrostatic latent image formed on the photosensitive drum 21 to form a toner image (manifest image), 24 denotes a transfer roller that transfers the toner image formed on the photosensitive drum 21 onto a transfer material P to form an image on the transfer material P, 25 denotes a cleaning unit that collects non-transferred toner on the photosensitive drum 21, 30 denotes a transfer belt in a transfer belt unit, 32Y, 32M, 32C, and 32BK denote toner supply units that supply toner of the respective colors (yellow, magenta, cyan, and black) to the developing units 23 in the respective process cartridges 20Y, 20M, 20C, and 20BK, 61 denotes a paper feed unit that stores the transfer materials P such as transfer paper, and 66 denotes a fixing unit installed on the downstream side of the transfer belt unit.

In the respective process cartridges 20Y, 20M, 20C, and 20BK, the photosensitive drum 21, the charging unit 22, the developing unit 23, and the cleaning unit 25 are integrally held by a case. Image formation of the respective colors (yellow, magenta, cyan, and black) is respectively performed on the photosensitive drum 21 in the respective process cartridges 20Y, 20M, 20C, and 20BK.

The four process cartridges 20Y, 20M, 20C, and 20BK are process cartridges compatible with each other. That is, the photosensitive drum 21, the charging unit 22, the developing unit 23, and the cleaning unit 25 housed in the four process cartridges 20Y, 20M, 20C, and 20BK are compatible members having the same shape and formed of the same material. The cases for the four process cartridges 20Y, 20M, 20C, and 20BK are formed of the same material in the same shape.

In the developing unit 23 in the compatible four process cartridges 20Y, 20M, 20C, and 20BK, a new carrier and a dummy toner are stored (in the state that these have not been used at all in the image forming apparatus main unit). After the new four process cartridges 20Y, 20M, 20C, and 20BK are installed in the installation section of the apparatus main unit 1, the respective color toners are supplied to the four process cartridges 20Y, 20M, 20C, and 20BK from the toner supply units 32Y, 32M, 32C, and 32BK provided in the apparatus main unit 1.

The four photosensitive drums 21 respectively rotate in the clockwise direction in FIG. 1. The surfaces of the photosensitive drums 21 are uniformly charged at a position opposite to the charging unit 22. Thereafter, the charged surfaces of the photosensitive drums 21 reach the respective laser beam irradiation positions.

On the other hand, in the optical unit 2 installed in the upper part of the apparatus main unit 1, laser beams corresponding to the image information are emitted from a light source, corresponding to the respective colors. The laser beams enter into a polygon mirror 3 and reflected, and then pass through lenses 4 and 5. The laser beams after having passed through the lenses 4 and 5 pass through different optical paths for each color component of yellow, magenta, cyan, and black.

The laser beam for the yellow component is reflected by mirrors 6 to 8, and then irradiated onto the surface of the photosensitive drum 21 in the first process cartridge 20Y from the right on the page. At this time, the laser beam for the yellow component is scanned in a direction of the rotation axis of the photosensitive drum 21 (in the horizontal scanning direction) by the polygon mirror 3 rotating at a high speed. An electrostatic latent image by the yellow component is formed on the photosensitive drum 21 charged by the charging unit 22.

The laser beam for the magenta component is reflected by mirrors 9 to 11, and then irradiated onto the surface of the photosensitive drum 21 in the second process cartridge 20M from the right on the page, to form an electrostatic latent image by the magenta component. The laser beam for the cyan component is reflected by mirrors 12 to 14, and then irradiated onto the surface of the photosensitive drum 21 in the third process cartridge 20C from the right on the page, to form an electrostatic latent image by the cyan component. The laser beam for the black component is reflected by a mirror 15, and then irradiated onto the surface of the photosensitive drum 21 in the fourth process cartridge 20BK from the right on the page, to form an electrostatic latent image by the black component.

The surface of the photosensitive drum 21, on which the electrostatic latent image of each color is formed, further rotates, and reaches a position opposite to the developing unit 23. The respective color toner is supplied from the developing unit 23 to the photosensitive drum 21, to develop the latent image on the photosensitive drum 21.

At this time, the state in the respective developing units 23 is such that the respective color toner supplied from the respective toner supply units 32Y, 32M, 32C, and 32BK is mixed with the carrier initially stored therein.

A yellow toner image is formed on the surface of the photosensitive drum 21 in the first process cartridge 20Y from the right on the page, corresponding to the yellow toner supplied from the yellow toner supply unit 32Y to the developing unit 23.

A magenta toner image is formed on the surface of the photosensitive drum 21 in the second process cartridge 20M from the right on the page, corresponding to the magenta toner supplied from the magenta toner supply unit 32M to the developing unit 23. A cyan toner image is formed on the surface of the photosensitive drum 21 in the third process cartridge 20C from the right on the page, corresponding to the cyan toner supplied from the cyan toner supply unit 32C to the developing unit 23. Further, a black toner image is formed on the surface of the photosensitive drum 21 in the fourth process cartridge 20BK from the right on the page, corresponding to the black toner supplied from the black toner supply unit 32BK to the developing unit 23.

The toner supply from the respective toner supply units 32Y, 32M, 32C, and 32BK to the developing units 23 is appropriately performed corresponding to the toner consumption in the developing unit 23 (indirectly detected by a toner density sensor 28 shown in FIG. 2) at a developing step.

The surface of the photosensitive drum 21 after the developing step respectively reaches a position opposite to a transfer belt 30. At the respective opposite positions, a transfer roller 24 is installed so as to abut against the inner circumference of the transfer belt 30. At the position of the transfer roller 24, the respective color toner image formed on the photosensitive drum 21 is sequentially transferred to the transfer material P carried by the transfer belt 30 (a transfer step).

In the transfer belt unit, the transfer belt 30 is spanned over and supported by a driver roller and three driven rollers. The transfer belt 30 travels in a direction of arrow in the figure by the drive roller. The transfer belt unit functions as a transfer unit in an image forming process, in which members such as the transfer roller 24 and the transfer belt 30 are integrally formed.

The dummy toner initially stored in the developing unit 23 together with the carrier is formed so as not to contribute to the image formation on the transfer material P at the transfer step (the details thereof will be explained later).

The surface of the photosensitive drum 21 after the transfer step then reaches a position opposite to the cleaning unit 25, respectively. The non-transferred toner remaining on the photosensitive drum 21 is then collected by the cleaning unit 25.

The surface of the photosensitive drum 21 passes a discharging unit (not shown), to finish a series of image forming processes.

On the other hand, the transfer material P fed from the paper feed unit 61 by a paper feed roller 62 passes through a transfer guide 63, and is guided to the position of a resist roller 64. The transfer material P guided to the resist roller 64 is carried toward an abutment portion between the transfer belt 30 and an attraction roller 27, with the traveling timing controlled.

The transfer material P sequentially passes positions opposite to the four photosensitive drums 21, while being carried by the transfer belt 30 traveling in the direction of arrow in the figure. Thus, the respective color toner images are superposedly transferred onto the transfer material P, to form a color image.

The transfer material P, on which the color image is formed, is separated from the transfer belt 30 in the transfer belt unit and guided to the fixing unit 66. In the fixing unit 66, the color image is fixed on the transfer material P at a nip between a heating roller 67 and a pressure roller 68.

The transfer material P after the fixing step is ejected to the outside of the apparatus main unit 1 by a paper ejection roller 69, thereby finishing the series of operation of the image forming apparatus.

The process cartridge detachably installed in the image forming apparatus main unit 1 will be explained in detail, with reference to FIGS. 2 and 3.

As explained above, the four process cartridges installed in the apparatus main unit 1 have compatibility. Therefore, in FIGS. 2A to 2C and FIG. 3, the process cartridge is shown without the alphabet (Y, M, C, and BK).

Figure 2A:
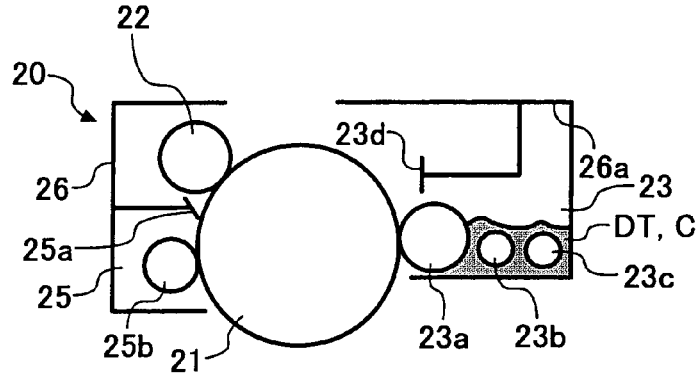
FIGS. 2A to 2C are cross sections of a process cartridge according to the first embodiment.

FIG. 2A is a cross section of a new process cartridge 20. In the process cartridge 20, the photosensitive drum 21 as the image carrier, the charging unit 22, the developing unit 23, and the cleaning unit 25 are integrally housed in a case 26. The stock control is performed in the manufacturers and shops in a unit of the process cartridge 20, and the replacement with respect to the apparatus main unit is performed by an operator.

The developing unit 23 in the process cartridge 20 mainly includes a developing roller 23*a*, stirring rollers 23*b* and 23*c*, a doctor blade 23*d*, and the like. The carrier C and the dummy toner DT are stored in the developing unit 23 in the new process cartridge 20.

The dummy toner DT is similar to the normal toner T in the structure and the property, but is different in that it is formed so that the contribution thereof to the image formation at the transfer step is small.

That is, even when the dummy toner DT is mixed with the carrier C, together with the normal toner T (toner of multiple colors supplied from the toner supply units 32Y, 32M, 32C, and 32BK in FIG. 1), it does not have any influence on the image transferred from the photosensitive drum 21 to the transfer paper P at the transfer step, so that any problem does not occur in the image. On the other hand, the dummy toner DT is stored in the new developing unit 23 together with the carrier C, to prevent the function of the developing unit 23 at the time of startup from deteriorating.

Specifically, the dummy toner DT is formed such that the charging ability thereof becomes smaller than that of any other color toners T. More specifically, the dummy toner DT is formed such that the saturated charged amount thereof becomes smaller than that of the toner T, by adjusting the added amount of a charge control agent.

The dummy toner DT is a transparent toner, which does not contain a colorant. That is, the normal toner T forms four colors of yellow, magenta, cyan, and black, by using various materials as a colorant in the toner base particles. On the other hand, the dummy toner DT constitutes a transparent toner (being a toner having high transparency), by not adding a colorant used in the normal toner T.

For the transparent toner, those disclosed in Japanese Patent Application Laid-Open Nos. 2001-175022 and 2003-91095 can be used.

Further, the dummy toner DT contains a binder resin in the toner base particles, as in the normal toner T. The binder resin in the dummy toner DT is formed such that a haze value in a dispersion becomes 10% to 40%. As a result, the transparency of the dummy toner DT further increases.

The haze value is measured by a known measuring method by using a "model 1001 DP type turbidity meter" manufactured by Nippon Denshoku (for example, see p. 4, 537 U.S. Pat. No. 2,942,042).

The dummy toner DT is also formed so as to have electroconductivity. More specifically, the dummy toner DT is formed by coating the toner base particles with electroconductive fine particles. For the electroconductive fine particles, various conductive particles, for example, conductive inorganic particles of metal oxides such as zinc oxide and alumina, and a mixture with organic substance, or the one obtained by subjecting these to surface treatment. The electroconductive fine particles are preferably white so as not to affect the image on the transfer material.

The dummy toner DT is formed such that the electrical resistance thereof is smaller than that of the normal toner T, which contributes to image formation.

The dummy toner DT is also formed so as to contain fatty acid metal salt as a lubricant. As the fatty acid metal salt, a higher fatty acid such as stearic acid or palmitic acid is used for the fatty acid of the fatty acid metal salt, and zinc, aluminum, or alkaline-earth metal can be used for the metal of the fatty acid metal salt.

On the other hand, the carrier C stored in the developing unit 23 when the process cartridge 20 is new is stored therein as it is, after the image formation is started until the service life of the process cartridge 20 finishes.

For the carrier C, the one used in the conventional image forming apparatus can be directly used, but the one described below is preferable in view of the compatibility with the dummy toner DT.

That is, the carrier C is preferably formed such that the true density is from 1.5 g/cm$^3$ to 6.0 g/cm$^3$, the weight average particle diameter is from 15 micrometers to 60 micrometers, and the shape factor SF2 is from 100 to 150. As a result, the carrier C has a round shape and a light weight, thereby reducing a load due to stirring by stirring rollers 23*b* and 23*c* in the developing unit 23, and reducing a damage of the dummy toner DT and the toner T.

The particle diameter of the carrier C is measured by a "microtrack particle diameter analyzer" manufactured by LEEDS & NORTHRUP, and the mean particle diameter can be determined according to the following equations:

Weight average particle diameter $Dv=[1/\Sigma(nd3)]\times[\Sigma$ (sum total of volume of particles present in $k$ channel)×(intermediate particle diameter of $k$ channel)], and Number average particle diameter $Dp=(1/\text{total particle numbers})\times[\Sigma(\text{sum total of particles present in } k \text{ channel})\times(\text{intermediate particle diameter of } k \text{ channel})]$.

The shape factor SF2 can be determined by analyzing a carrier particle image enlarged by using the "FE-SEM (S-800)" manufactured by Hitachi, Ltd., by the "image analyzer (Luzex 3)" manufactured by Nireco Corporation.

It is preferable that the carrier C is a magnetically dispersed binder carrier. As a result, the carrier C has a small specific gravity, thereby reducing the stirring load due to the stirring rollers 23*b* and 23*c* in the developing unit 23, and reducing a damage of the dummy toner DT and the toner T.

It is also preferable that the carrier C is a coat carrier. More specifically, the carrier C as the coat carrier forms a coat layer containing fluororesin fine particles with respect to nuclide particles having magnetism. As a result, the mechanical durability of the carrier C itself is improved, thereby enabling extension of the service life of the process cartridge 20.

As described above, in the new process cartridge 20 shown in FIG. 2A, the dummy toner DT as a common toner is stored together with the carrier C in the developing unit 23, without including any toner T of yellow, magenta, cyan, and black. That is, the new process cartridge 20 is not the four types of incompatible process cartridges of yellow, magenta, cyan, and black, but is common and compatible process cartridge.

Figure 2B:
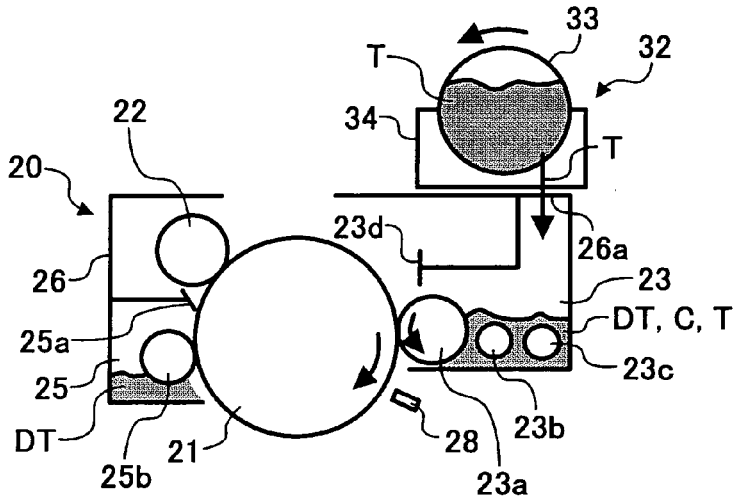

The process cartridge 20 having the compatibility (the one shown in FIG. 2A) is installed in the installation section of the apparatus main unit, as shown in FIG. 2B.

Figure 3:
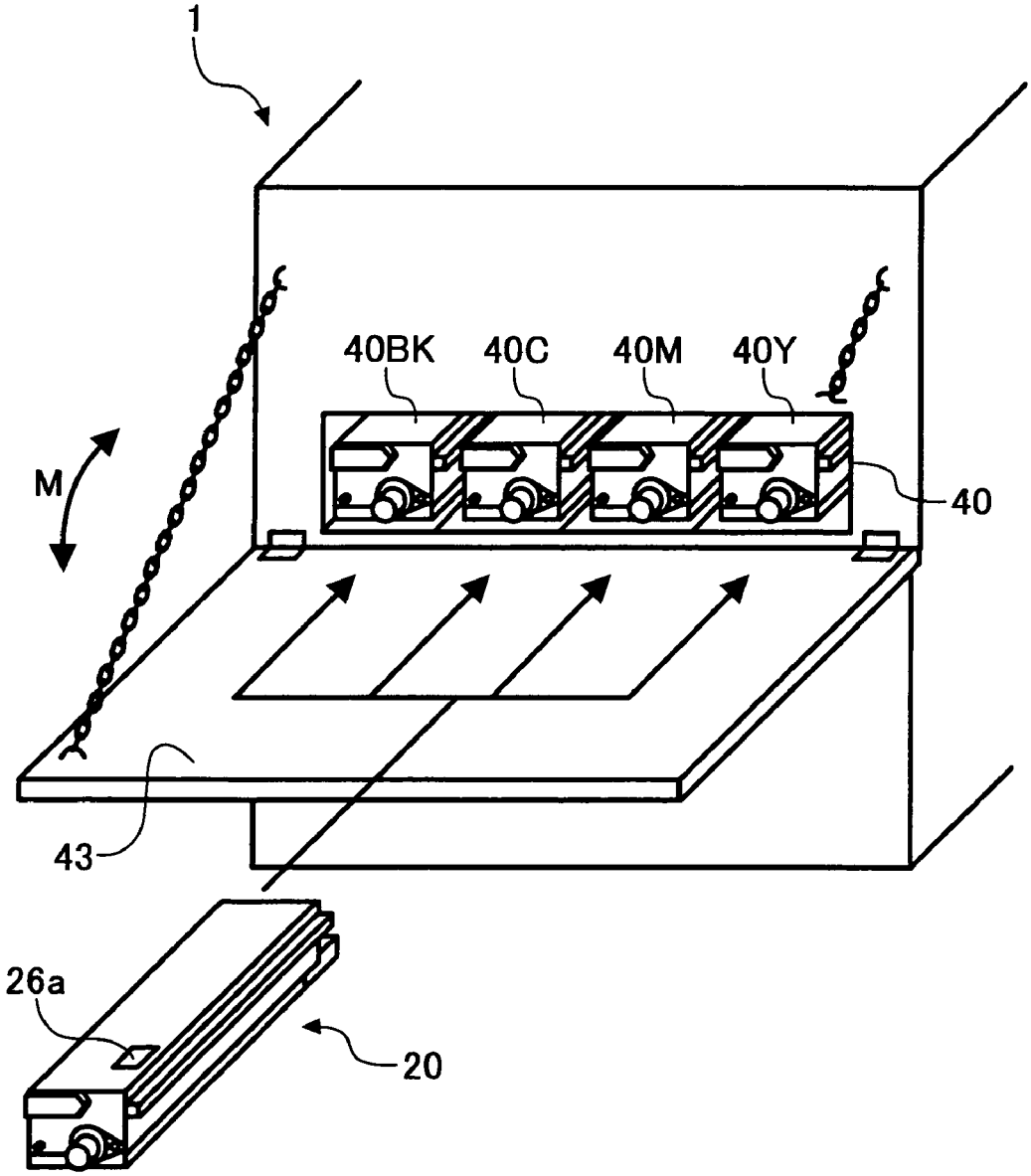
FIG. 3 is a perspective view of an installation state of the process cartridge according to the first embodiment.

More specifically, as shown in FIG. 3, when the operator moves a door 43 of the apparatus main unit 1 in a direction of arrow M, an opening 40 including four installation sections 40Y, 40M, 40C, and 40BK corresponding to the respective colors (yellow, magenta, cyan, and black) is opened. Referring to the arrows in FIG. 3, the new process cartridge 20 having the compatibility can be installed in any one of the four installation sections 40Y, 40M, 40C, and 40BK.

Though not shown, a rail for guiding the process cartridge 20 into the apparatus main unit 1 is installed, respectively, in the four installation sections 40Y, 40M, 40C, and 40BK. As shown in FIG. 2B, the supply ports 26*a* of the toner cartridges 20 installed in the respective installation sections engage with toner supply units 32 of the respective colors secured on the apparatus main unit 1 side. Though not shown, a drive transmission unit of the toner cartridge 20 engages with a drive unit secured on the furthermost side of the apparatus main unit 1.

The four toner supply units 32 provided in the apparatus main unit respectively include a replaceable toner bottle 33, and a bottle holding unit 34 that holds and rotates the toner bottle 33 and supplies the toner T to the developing unit 23 in the toner cartridge 20. The normal toner T (either one of yellow, magenta, cyan, and black) is stored in the toner bottle 33.

Referring to FIG. 2B, the toner T in the toner bottle 33 rotated in a direction of arrow in the figure is supplied to the developing unit 23 via the bottle holding unit 34 and the supply port 26*a* provided in the case 26 of the process cartridge 20 (which is a route shown by arrow T), during the time after the installation and until image formation on the transfer material P is started (at the time of warm up, that is, at the time of initial setting of the process cartridge 20). In other words, at the time of warm up, the carrier C, the toner T, and the dummy toner DT are in a state of being mixed in the developing unit 23.

Figure 2C:
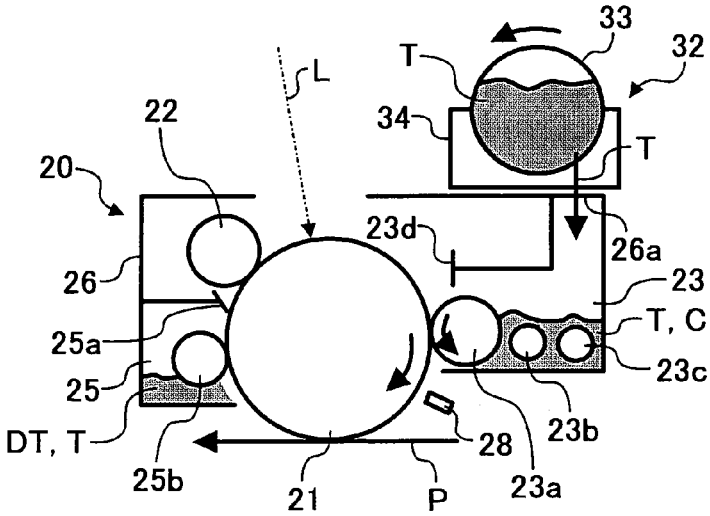

Referring to FIG. 2C, the toner T in the toner bottle 33 is appropriately supplied to the developing unit 23, based on a detection result of a toner density sensor 28 that optically detects the density of a patch pattern (a substantially rectangular toner image) on the photosensitive drum 21.

Referring to FIG. 2B, most of the dummy toner DT initially stored in the developing unit 23 is discharged from the developing unit 23 at the time of warm up (a discharge step). Finally, only the carrier C and the toner T remain in the developing unit 23.

This is because the saturated charged amount of the dummy toner DT is smaller than that of the toner T.

In other words, the dummy toner DT in the developing unit 23 is mixed with the carrier C, together with the toner T supplied from the toner supply unit 32, by the stirring rollers 23*b* and 23*c* rotating in the counterclockwise direction in the figure, at the time of warm up. At this time, the charged amount of the dummy toner DT becomes smaller than that of the toner T. The slightly and frictionally charged dummy toner DT is carried on the developing roller 23*a* together with the carrier C by one stirring roller 23*b*.

On the other hand, the developing roller 23*a* rotates in a direction of arrow in the figure. The dummy toner DT carried on the developing roller 23*a* passes the position of the doctor blade 23*d*, and reaches the position opposite to the photosensitive drum 21. At the opposite position, the dummy toner DT adheres on the surface of the photosensitive drum 21 as a surface stain. More specifically, the weakly charged dummy toner DT adheres on the surface of the photosensitive drum 21, due to an electric field formed by a potential difference between the surface potential in the background region (a region in which the laser beams L are not irradiated) charged by the charging unit 22, and the developing potential applied to the developing roller 23*a*.

The properly charged toner T does not adhere in the background region of the photosensitive drum 21. Therefore, the toner T is hardly consumed in the developing unit 23, until the normal image formation accompanying the irradiation of the laser beams L is started.

The dummy toner DT adhered on the photosensitive drum 21 is then collected in the cleaning unit 25 by the cleaning blade 25*a* and the cleaning roller 25*b*.

The discharge step of the dummy toner DT can be controlled based on the detection result by the toner density sensor 28. That is, a patch pattern is formed on the photosensitive drum 21 at a predetermined timing, and the density thereof is detected by the toner density sensor 28, thereby grasping the consumed amount of the dummy toner DT in the developing unit 23 to some extent. When the detection result by the toner density sensor 28 reaches a predetermined value, the control relating to the discharge step (warm up) is finished. As a result, the dummy toner DT is discharged efficiently and reliably from the developing unit 23.

Further, the efficiency at the discharge step can be increased by adjusting the potential difference relating to the background region to positively facilitate the discharge of the dummy toner DT.

In the new process cartridge 20, not the toner T that contributes to image formation, but the dummy toner DT that does not contribute to image formation is stored together with the carrier C in the developing unit 23. The dummy toner DT has characteristics similar to those of the normal toner T, except the charging characteristic, the optical characteristic, and the electrical characteristic. Therefore, the dummy toner DT contributes to frictional charging of the carrier C from the initial stage of warm up and facilitates mixing, and hence startup of charging of the supplied toner T and uniform mixing promptly proceed at the time of warm up.

Though not shown, the process cartridge 20 is provided with an IC chip, a claw member that deforms synchronized with the first mounting operation to the installation section, and the like. On the other hand, the apparatus main unit 1 is provided with a recognizing unit that recognizes IC chip data and deformation of the claw member. By such a configuration, the apparatus main unit 1 determines whether the process cartridge 20 installed in the installation section is new, to perform control at the discharge step.

Referring to FIG. 2C, after warm up has finished, normal image formation is carried out. The normal image formation is carried out as explained with reference to FIG. 1.

At this time, the toner T in the toner bottle 33 is appropriately supplied to the developing unit 23 with the consumption of the toner T in the developing unit 23. That is, the carrier C and the toner T are present together in the developing unit 23. The frictionally charged toner T is carried on the developing roller 33*a* together with the carrier C, and then the electrostatic latent image on the photosensitive drum 21 is developed. Thus, a toner image of a desired color (when the toner T is the yellow toner, a yellow toner image) is formed on the photosensitive drum 21.

The dummy toner DT does not contain a colorant, and the haze value of the binder resin is made appropriate, to have high transparency. Therefore, when warm up has finished and normal image formation is performed, even if the dummy toner DT remains in the developing unit 23, there is little influence thereof on the image formed on the transfer material P, causing no problem in the image.

According to the first embodiment, the dummy toner DT does not contain a colorant. However, even when a colorant such as white, yellow, or a light color is used, the influence on the color reproducibility of the image can be reduced. Specifically, with respect to an image formed when the toner deposition amount in a toner image on the photosensitive drum 21 becomes 1.0 mg/cm$^2$, the reflection density measured by an "X-lite 938" manufactured by X-lite becomes equal to or less than 0.2 (at maximum, equal to or less than 0.4).

The dummy toner DT is formed so as to have a low electrical resistance. Therefore, when warm up has finished and normal image formation is performed, even when the dummy toner DT remains in the developing unit 23, the dummy toner DT deposited on the photosensitive drum 21 is hardly transferred onto the transfer material P by a transfer current applied to the transfer roller 24 shown in FIG. 1.

The dummy toner DT contains a lubricant formed of a fatty acid metal salt. Therefore, mixing with the carrier C is carried out smoothly, to reduce a damage of the carrier C, and further reduce a damage of the members such as developing roller 23*a* and the photosensitive drum 21.

For the lubricant in the dummy toner DT, fluororesin fine particles, silicone oil, or silicone varnish can be used other than the fatty acid metal salt. Also in this case, the effects similar to those described above can be obtained. For the fluororesin fine particles, known particles can be used, but it is preferable to use a polymer or a copolymer such as vinylidene fluoride, tetrafluoroethylene, ethylene chloride trifluoride, propylene hexafluoride, and hexafluoroisopropyl methacrylate, and it is particularly preferable to use polyvinylidene fluoride or polytetrafluoroethylene. For the silicone oil, the one having a viscosity of from 1 $mm^2/s$ to 200,000 $mm^2/s$ at 25° C. is preferred (and more preferably, from 10 $mm^2/s$ to 80,000 $mm^2/s$), and for example, dimethyl silicone oil, methylphenyl silicone oil, α-methylstyrene denatured silicone oil, chlorophenyl silicone oil, fluorine denatured silicone oil or the like can be used.

In the image forming apparatus constituted as in the first embodiment, process cartridges 20 installed in the installation sections 40Y, 40M, 40C, and 40BK corresponding to the multiple colors can be made common regardless of colors, by storing the carrier C and the dummy toner DT as the common toner in the developing unit 23.

As a result, it is not necessary to perform stock control of the four types of incompatible process cartridges separately, thereby reducing the stock control cost for the new process cartridges 20 for replacement. Further, it is not necessary to produce four types of incompatible process cartridges separately, thereby reducing the production cost of the process cartridges 20.

Further, such a replacement error that the operator installs a process cartridge 20 in a wrong installation section 40Y, 40M, 40C, or 40BK can be prevented, and a delay in the replacement due to an incorrect order of the incompatible process cartridge can be prevented. That is, the maintenance operation of the process cartridges 20 due to the service life or a failure can be performed accurately, efficiently, and within short time.

The "process cartridge" is obtained by integrally forming at least one of the charging unit, the developing unit, and the cleaning unit, and the image carrier (the photosensitive drum), and is detachably installed in the image forming apparatus main unit.

According to the first embodiment, the process cartridge 20 has a configuration such that the photosensitive drum 21, the charging unit 22, the developing unit 23, and the cleaning unit 25 are integrally held in the case 26. On the other hand, the configuration of the process cartridge, to which the present invention is applied, can be made such that the process cartridge is formed of the photosensitive drum 21 and the developing unit 23. Further, the process cartridge may be formed of the photosensitive drum 21, the developing unit 23, and the charging unit 22 or the cleaning unit 25. Also in this case, the effects similar to those of the first embodiment can be obtained.

According to the first embodiment, the present invention is applied to an image forming apparatus in which the process cartridge 20 having the developing unit 23 is detachably installed. On the other hand, the present invention is also applicable to an image forming apparatus having a developing unit detachably and singly installed in the apparatus main unit 1, not in the configuration of the process cartridge. In this case, the dummy toner DT and the carrier C are stored in the new developing unit, as in the first embodiment, and the developing unit is commonly used. After a plurality of compatible developing unites are installed in a plurality of installation sections in the apparatus main unit, the toner T is supplied to the developing unit from the toner supply units of respective colors provided in the apparatus main unit. Even in the image forming apparatus having such a developing unit, the effects similar to those of the first embodiment can be obtained.

An image forming apparatus according to a second embodiment of the present invention will be explained next. The second embodiment is basically the same as the first embodiment, except using a process cartridge 120 instead of the process cartridge 20 in the first embodiment. Therefore, only the different part will be explained in detail.

The four process cartridges are process cartridges having compatibility with each other, as in the first embodiment, and the process cartridges are formed in the same shape with the same material.

The process cartridge according to the second embodiment, which is detachably installed in the image forming apparatus main unit 1, will be explained in detail, with reference to FIGS. 4 and 5.

The four process cartridges installed in the apparatus main unit 1 have compatibility with each other. Therefore, in FIGS. 4 and 5, the process cartridge is illustrated without alphabets (Y, M, C, and BK) as the reference sign.

Figure 4A:
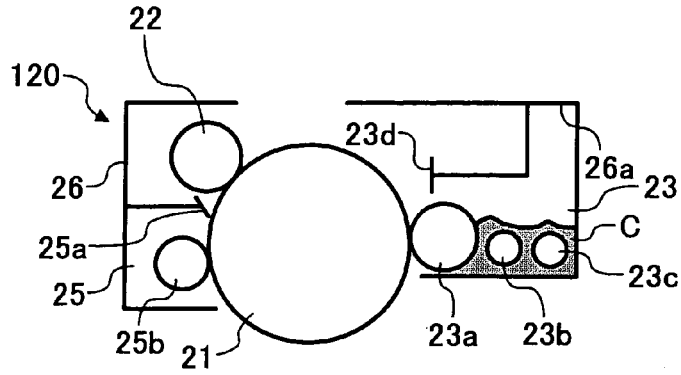
FIGS. 4A to 4C are cross sections of a process cartridge according to a second embodiment.

FIG. 4A is a cross section of a new process cartridge 120. In the process cartridge 120, the photosensitive drum 21 as the image carrier, the charging unit 22, the developing unit 23, and the cleaning unit 25 are integrally housed in the case 26. Stock control in the manufacturers and shops is carried out in a unit of the process cartridge 120, and replacement to the apparatus main unit is carried out by an operator.

The developing unit 23 in the process cartridge 120 mainly includes the developing roller 23*a*, the stirring rollers 23*b* and 23*c*, and the doctor blades 23*d*. Only the carrier C is stored in the developing unit 23 in the new process cartridge 120.

The carrier C stored in the developing unit 23 when the process cartridge 120 is new is stored as it is in the developing unit 23, after image formation is started and until the service life of the process cartridge 120 finishes.

The carrier C used in the conventional image forming apparatus can be used as it is. After the process cartridges 120 are installed in the installation sections corresponding to the respective colors of yellow, magenta, cyan, and black, the carrier C is mixed with the respective color toners in the developing unit 23.

It is preferable that the carrier C has a true density of from 1.5 $g/cm^3$ to 6.0 $g/cm^3$ a weight average particle diameter of from 15 micrometers to 60 micrometers, and a shape factor SF2 of from 100 to 150. As a result, the carrier C has a round shape and a light weight, thereby reducing a load due to stirring by stirring rollers 23*b* and 23*c* in the developing unit 23, and reducing a damage of the carrier C and the toner T. The average particle diameter of the carrier C can be determined in the same manner as in the first embodiment.

The carrier C is preferably a magnetically dispersed binder carrier. As a result, the carrier C has a small specific gravity, thereby reducing the stirring load due to the stirring rollers 23*b* and 23*c* in the developing unit 23, and reducing a damage of the carrier C and the toner T.

It is also preferable that the carrier C is a coat carrier. More specifically, the carrier C as the coat carrier forms a coat layer containing fluororesin fine particles with respect to nuclide particles coated with electroconductive fine particles. As a result, the mechanical durability of the carrier C itself is improved, thereby enabling extension of the service life of the process cartridge 120. For the electroconductive fine particles, various conductive particles, for example, conductive inorganic particles of metal oxides such as zinc oxide and alumina, and a mixture with organic substance, or the one obtained by subjecting these to surface treatment. The electroconductive fine particles are preferably white so as not to affect the image on the transfer material.

It is also preferable that the carrier C is formed by coating the nuclide particles with a lubricant such as fatty acid metal salt, fluororesin fine particles, silicone oil, or silicone varnish. As a result, the stirring load by the stirring rollers 23*b* and 23*c* in the developing unit 23 is reduced, thereby reducing a damage of the carrier C and the toner T.

As the fatty acid metal salt, a higher fatty acid such as stearic acid or palmitic acid is used for the fatty acid of the fatty acid metal salt, and zinc, aluminum, or alkaline-earth metal can be used for the metal of the fatty acid metal salt. For the fluororesin fine particles, known particles can be used, but it is preferable to use a polymer or a copolymer such as vinylidene fluoride, tetrafluoroethylene, ethylene chloride trifluoride, propylene hexafluoride, and hexafluoroisopropyl methacrylate, and it is particularly preferable to use polyvinylidene fluoride or polytetrafluoroethylene. For the silicone oil, the one having a viscosity of from 1 $mm^2/s$ to 1200000 $mm^2/s$ at 25° C. is preferred (and more preferably, from 10 $mm^2/s$ to 80000 $mm^2/s$), and for example, dimethyl silicone oil, methylphenyl silicone oil, α-methylstyrene denatured silicone oil, chlorophenyl silicone oil, fluorine denatured silicone oil or the like can be used.

In the new process cartridge 120 shown in FIG. 4A, any toner T of yellow, magenta, cyan, and black is not stored in the developing unit 23, and only the carrier C common to the respective colors is stored. That is, the new process cartridge 120 is not the four types of incompatible process cartridges of yellow, magenta, cyan, and black, but is a common and compatible process cartridge.

Figure 4B:
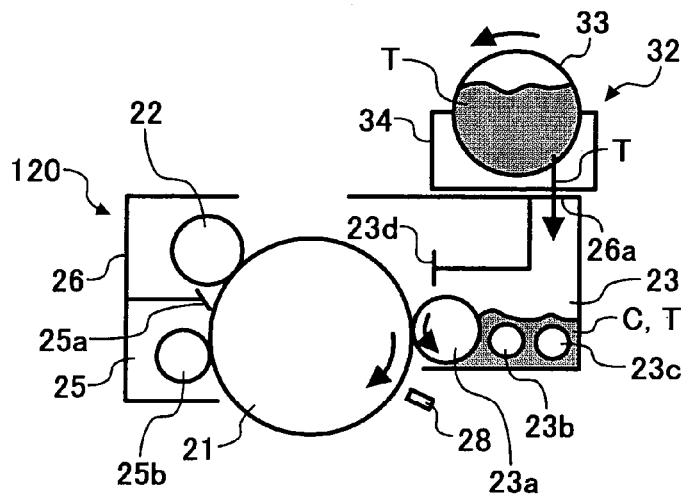

The compatible process cartridge 120 (shown in FIG. 4A) is installed in the installation section in the apparatus main unit, as shown in FIG. 4B.

Figure 5:
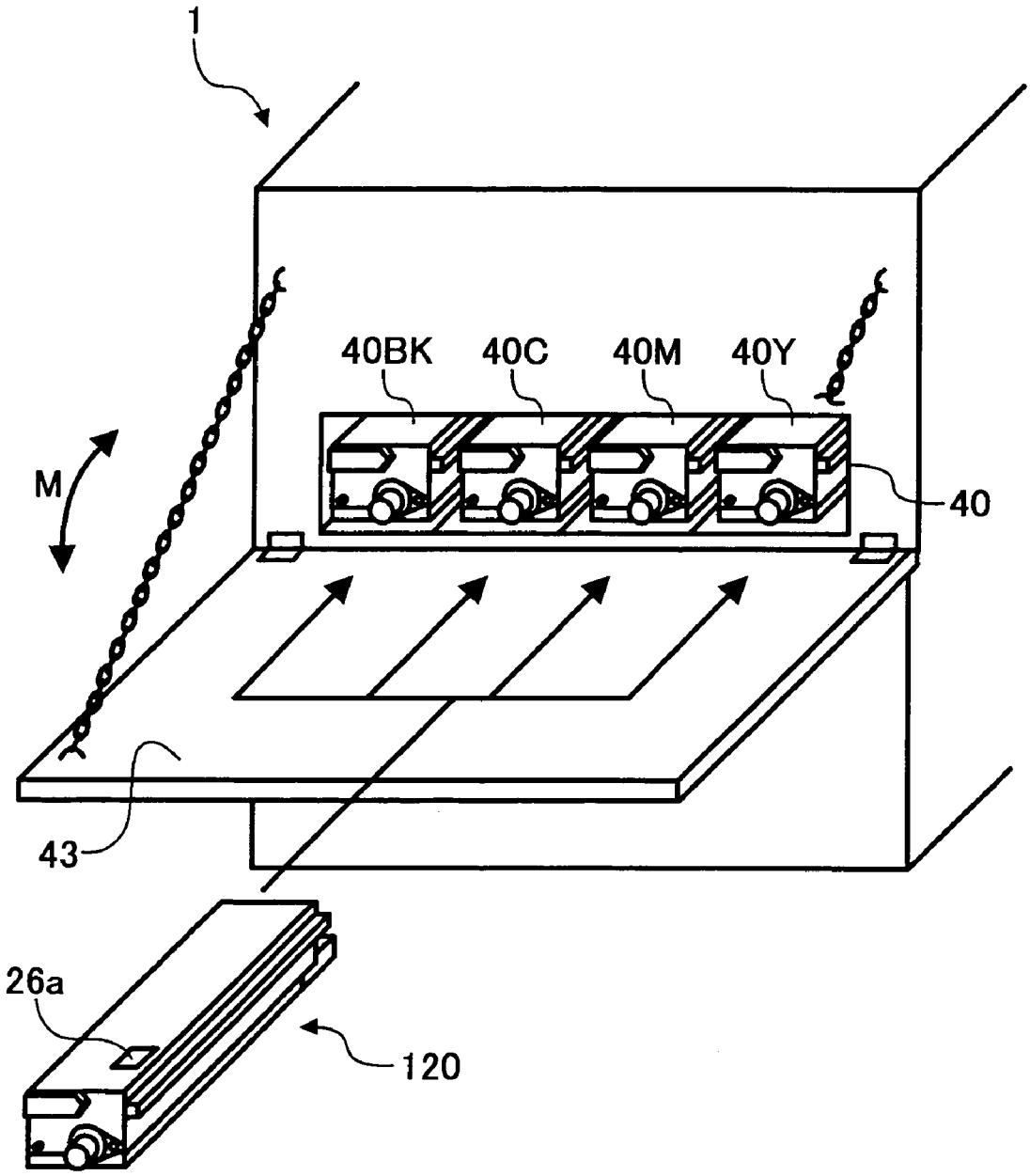
FIG. 5 is a perspective view of an installation state of the process cartridge according to the second embodiment.

More specifically, as shown in FIG. 5, when the operator shifts the door 43 of the apparatus main unit 1 in the direction of arrow M, the opening 40 including four installation sections 40Y, 40M, 40C, and 40BK corresponding to the respective colors (yellow, magenta, cyan, and black) is opened. Referring to the arrows in FIG. 5, the new process cartridge 20 having the compatibility can be installed in any one of the four installation sections 40Y, 40M, 40C, and 40BK.

Though not shown, the rail for guiding the process cartridge 120 into the apparatus main unit 1 is installed, respectively, in the four installation sections 40Y, 40M, 40C, and 40BK. As shown in FIG. 4B, the supply ports 26*a* of the toner cartridges 120 installed in the respective installation sections engage with toner supply units 32 of the respective colors secured on the apparatus main unit 1 side. Though not shown, a drive transmission unit of the toner cartridge 120 engages with a drive unit secured on the furthermost side of the apparatus main unit 1.

The four toner supply units 32 provided in the apparatus main unit respectively include the replaceable toner bottle 33, and the bottle holding unit 34 that holds and rotates the toner bottle 33 and supplies the toner T to the developing unit 23 in the toner cartridge 120. The toner T (either one of yellow, magenta, cyan, and black) is stored in the toner bottle 33.

Referring to FIG. 4B, the toner T in the toner bottle 33 rotated in a direction of arrow in the figure is supplied to the developing unit 23 via the bottle holding unit 34 and the supply port 26*a* provided in the case 26 of the process cartridge 120 (which is a route shown by arrow T), during the time after the installation and until image formation on the transfer material P is started (at the time of warm up, that is, at the time of initial setting of the process cartridge 120). In other words, at the time of warm up, the carrier C and the toner T are in a state of being mixed in the developing unit 23.

Figure 4C:
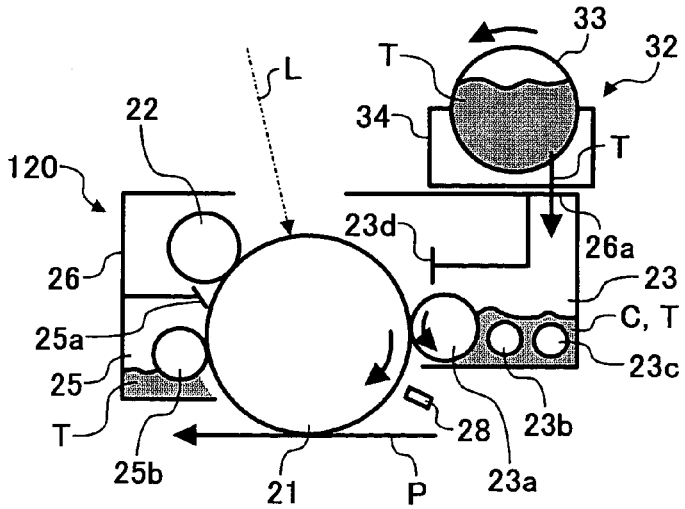

Referring to FIG. 4C, the toner T in the toner bottle 33 is appropriately supplied to the developing unit 23, based on a detection result of the toner density sensor 28 that optically detects the density of the patch pattern (a substantially rectangular toner image) on the photosensitive drum 21.

Referring to FIG. 4B, the toner T supplied into the developing unit 23 from the toner supply unit 32 is mixed with the carrier C only for predetermined time, by the stirring rollers 23*b* and 23*c* rotating in the counterclockwise direction in the figure, at the time of warm up. As a result, the toner T in the developing unit 23 reaches the (initially set) desired charged state.

Though not shown, the process cartridge 120 is provided with an IC chip, a claw member that deforms synchronized with the first mounting operation to the installation section, and the like. On the other hand, the apparatus main unit 1 is provided with a recognizing unit that recognizes IC chip data and deformation of the claw member.

By such a configuration, the apparatus main unit 1 determines whether the process cartridge 120 installed in the installation section is new, to perform warm up.

Referring to FIG. 4C, after warm up has finished, normal image formation is carried out. The normal image formation is carried out as explained with reference to FIG. 1.

That is, the toner T in the developing unit 23 charged by the warm up is carried on the developing roller 23*a* together with the carrier C, by one stirring roller 23*b*. On the other hand, the developing roller 23*a* rotates in a direction of arrow in the figure. The toner T carried on the developing roller 23*a* passes the position of the doctor blade 23*d*, and reaches a position opposite to the photosensitive drum 21. At the opposite position, the toner T adheres on an electrostatic latent image formed on the surface of the photosensitive drum 21.

At this time, the toner T in the toner bottle 33 is appropriately supplied to the developing unit 23 with the consumption of the toner T in the developing unit 23.

Thus, a toner image of a desired color (when the toner T is the yellow toner, a yellow toner image) is formed on the photosensitive drum 21.

In the image forming apparatus constituted as in the second embodiment, since the toner T is not stored in the developing unit 23 and only the carrier C is stored in the developing unit 23, the process cartridges 120 installed in the installation sections 40Y, 40M, 40C, and 40BK corresponding to multiple colors can be used commonly, regardless of colors.

As a result, it is not necessary to perform stock control of the four types of incompatible process cartridges separately, thereby reducing the stock control cost for the new process cartridges 120 for replacement. Further, it is not necessary to produce four types of incompatible process cartridges separately, thereby reducing the production cost of the process cartridges 120.

Further, such a replacement error that the operator installs a process cartridge 120 in a wrong installation section 40Y, 40M, 40C, or 40BK can be prevented, and a delay in the replacement due to an incorrect order of the incompatible process cartridge can be prevented. That is, the maintenance operation of the process cartridges 120 due to the service life or a failure can be performed accurately, efficiently, and within short time.

The "process cartridge" is obtained by integrally forming at least one of the charging unit, the developing unit, and the cleaning unit, and the image carrier (the photosensitive drum), and is detachably installed in the image forming apparatus main unit.

According to the second embodiment, the process cartridge 120 has the configuration such that the photosensitive drum 21, the charging unit 22, the developing unit 23, and the cleaning unit 25 are integrally held by the case 26. On the other hand, the configuration of the process cartridge, to which the present invention is applied, may be such that the process cartridge is formed of the photosensitive drum 21 and the developing unit 23. Further, the process cartridge may be formed of the photosensitive drum 21, the developing unit 23, and the charging unit 22 or the cleaning unit 25. Also in this case, the effects similar to those of the second embodiment can be obtained.

According to the second embodiment, the present invention is applied to an image forming apparatus in which the process cartridge 220 having the developing unit 23 is detachably installed. On the other hand, the present invention is also applicable to an image forming apparatus having a developing unit detachably and singly installed in the apparatus main unit 1, not in the configuration of the process cartridge. In this case, only the carrier C is stored in the new developing unit, as in the second embodiment, and the developing unit is commonly used. After a plurality of compatible developing unites are installed in a plurality of installation sections in the apparatus main unit, the toner T is supplied to the developing unit from the toner supply units of respective colors provided in the apparatus main unit. Even in the image forming apparatus having such a developing unit, the effects similar to those of the second embodiment can be obtained.

An image forming apparatus according to a third embodiment of the present invention will be explained next. The third embodiment is basically the same as the first embodiment, except using a process cartridge 220 instead of the process cartridge 20 in the first embodiment. Therefore, only the different part will be explained in detail.

The four process cartridges are process cartridges having compatibility with each other, as in the first embodiment, and the process cartridges are formed in the same shape with the same material.

The developing unit 23 in the four process cartridges (corresponding to the respective colors of Y, M, C, and BK) having compatibility with each other is a developing unit of a one-component developing method. The developing unit 23 in the four process cartridges is in an empty state in which the toner (one-component developer) is not stored, when it is new (the process cartridge has not yet been used in the image forming apparatus main unit 1). After the new four process cartridges are installed in the installation sections of the apparatus main unit 1, the respective color toners are supplied to the four process cartridges from the toner supply units 32Y, 32M, 32C, and 32BK provided in the apparatus main unit 1.

The process-cartridge detachably installed in the image forming apparatus main unit 1 will be explained in detail, with reference to FIGS. 6 and 7.

The four process cartridges installed in the apparatus main unit 1 have compatibility with each other. Therefore, in FIGS. 6 and 7, the process cartridge is shown without the alphabet (Y, M, C, and BK).

Figure 6A:
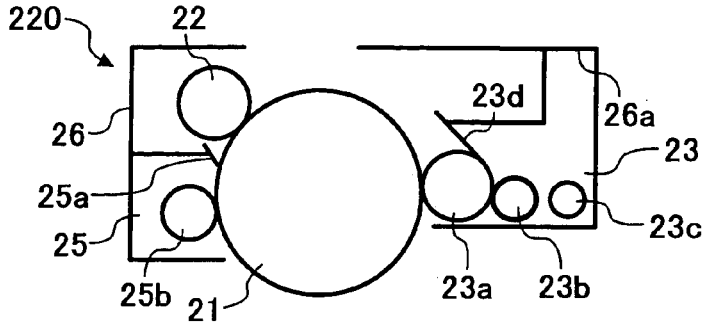
FIGS. 6A to 6C are cross sections of a process cartridge according to a third embodiment.

FIG. 6A is a cross section of a new process cartridge 20. In the process cartridge 220, the photosensitive drum 21 as the image carrier, the charging unit 22, the developing unit 23 of the one-component developing method, and the cleaning unit 25 are integrally housed in the case 26. The stock control is performed in the manufacturers and shops in a unit of the process cartridge 220, and the replacement with respect to the apparatus main unit is performed by an operator.

The developing unit 23 in the process cartridge 220 mainly includes the developing roller 23*a* as a toner carrier, a supply roller 23*b*, the stirring roller 23*c*, the doctor blade 23*d*, and the like. The toner T is not stored in the developing unit 23 in the new process cartridge 220.

The new process cartridge 220 shown in FIG. 6A is an empty state, in which any toner T of yellow, magenta, cyan, and black is not filled, and a sealing member for preventing toner scattering is not installed. That is, the new process cartridge 220 is not the four types of incompatible process cartridges of yellow, magenta, cyan, and black, but is a common and compatible process cartridge.

Figure 6B:
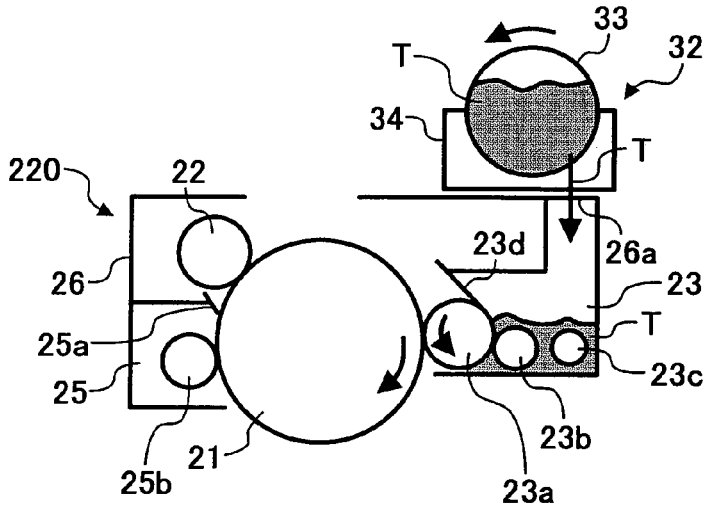

The compatible process cartridge 220 (shown in FIG. 6A) is installed in the installation section in the apparatus main unit as shown in FIG. 6B.

Figure 7:
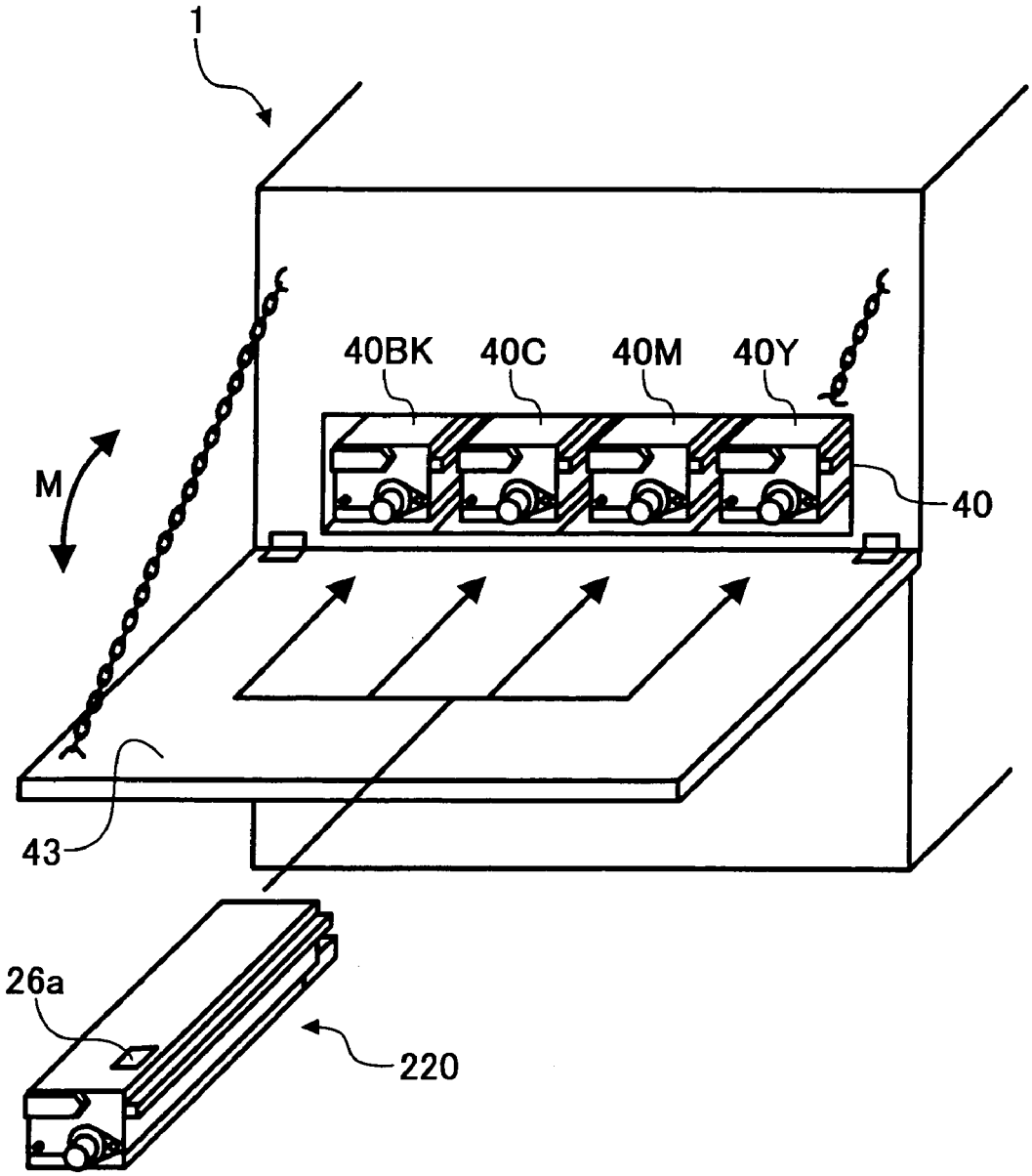
FIG. 7 is a perspective view of an installation state of the process cartridge according to the third embodiment.

More specifically, as shown in FIG. 7, when the operator moves the door 43 of the apparatus main unit 1 in a direction of arrow M, the opening 40 including four installation sections 40Y, 40M, 40C, and 40BK corresponding to the respective colors (yellow, magenta, cyan, and black) is opened. Referring to the arrows in FIG. 7, the new process cartridge 220 having the compatibility can be installed in any one of the four installation sections 40Y, 40M, 40C, and 40BK.

Though not shown, the rail for guiding the process cartridge 220 into the apparatus main unit 1 is installed, respectively, in the four installation sections 40Y, 40M, 40C, and 40BK. As shown in FIG. 6B, the supply ports 26*a* of the toner cartridges 220 installed in the respective installation sections engage with the toner supply units 32 of the respective colors secured on the apparatus main unit 1 side. Though not shown, a drive transmission unit of the toner cartridge 220 engages with a drive unit secured on the furthermost side of the apparatus main unit 1.

The four toner supply units 32 provided in the apparatus main unit respectively include the replaceable toner bottle 33, and the bottle holding unit 34 that holds and rotates the toner bottle 33 and supplies the toner T to the developing unit 23 in the toner cartridge 220. The toner T (either one of yellow, magenta, cyan, and black) as the one-component developer is stored in the toner bottle 33.

Referring to FIG. 6B, the toner T in the toner bottle 33 rotated in a direction of arrow in the figure is supplied to the developing unit 23 via the bottle holding unit 34 and the supply port 26*a* provided in the case 26 of the process cartridge 220 (which is a route shown by arrow T), during the time after the installation and until image formation on the transfer material P is started (at the time of warm up, that is, at the time of initial setting of the process cartridge 220). In other words, at the time of warm up, the toner T is in a state of being filled in the developing unit 23.

Figure 6C:
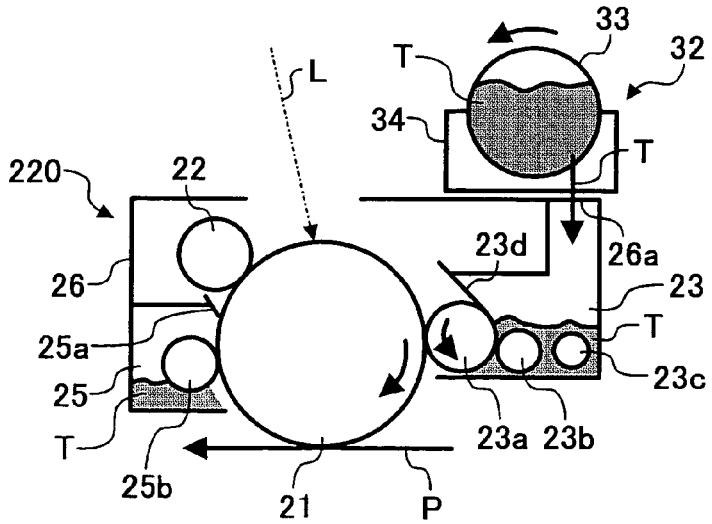

Referring to FIG. 6C, the toner T in the toner bottle 33 is appropriately supplied to the developing unit 23, based on the consumed amount of the toner in the developing unit 23.

The toner T supplied from the toner supply unit 32 contains a lubricant containing fatty acid metal salt, fluororesin fine particles, silicone oil, or silicone varnish. Therefore, mixing of the toner T can be performed smoothly, thereby reducing a damage of the members such as the developing roller 23*a*, the supply roller 23*b*, and the photosensitive drum 21.

Though not shown, the process cartridge 220 is provided with an IC chip, a claw member that deforms synchronized with the first mounting operation to the installation section, and the like. On the other hand, the apparatus main unit 1 is provided with a recognizing unit that recognizes IC chip data and deformation of the claw member. By such a configuration, the apparatus main unit 1 determines whether the process cartridge 220 installed in the installation section is new.

After the warm up has finished, normal image formation is carried out. The normal image formation is carried out as explained in FIG. 1.

Specifically, referring to FIG. 6C, the toner in the developing unit 23 is carried to the position of the supply roller 23*b* by the stirring roller 23*c* rotating in the clockwise direction in the figure. The toner T carried to the position of the supply roller 23*b* is carried to the position of the developing roller 23*a* by the supply roller 23*b* rotating in the counterclockwise direction in the figure. The toner T having reached the position of the developing roller 23*a* is frictionally charged at the nip between the developing roller 23*a* and the supply roller 23*b*, and carried on the developing roller 23*a*. The toner T carried on the developing roller 23*a* passes the position of the doctor blade 23*d* and is turned into a thin layer, and then reaches the position opposite to the photosensitive drum 21. At the opposite position, the toner adheres on an electrostatic latent image formed on the surface of the photosensitive drum 21.

In the image forming apparatus constituted as in the third embodiment, in addition to the effects similar to those of the second embodiment, it is not necessary to provide the sealing member for preventing toner scattering, thereby enabling a reduction in the production cost of the process cartridge 220.

Further, such a replacement error that the operator installs a process cartridge 220 in a wrong installation section 40Y, 40M, 40C, or 40BK can be prevented, and a delay in the replacement due to an incorrect order of the incompatible process cartridge can be prevented. Since the developing unit 23 in the process cartridge 22 does not require the sealing member for preventing toner scattering, the removal operation of the sealing member at the time of replacement is not necessary. That is, the maintenance operation of the process cartridges 220 due to the service life or a failure can be performed accurately, efficiently, and within short time.

According to the third embodiment, in the new process cartridge 220, nothing is carried on the developing roller 23*a* in the developing unit 23.

On the other hand, when it is preferable to improve a margin for preventing a damage of the members such as the developing roller 23*a*, the supply roller 23*b*, and the photosensitive drum 21, it is preferable that a lubricant containing fatty acid metal salt, fluororesin fine particles, silicone oil, or silicone varnish is carried beforehand on the new developing roller 23*a*.

Likewise, the margin for preventing a damage of the members such as the developing roller 23*a*, the supply roller 23*b*, and the photosensitive drum 21 can be improved by allowing a dummy toner different from the toner T contributing to the image formation to be carried on the new developing roller 23*a*.

As the dummy toner to be deposited on the new developing roller 23*a*, it is preferable to use a transparent toner, which does not contain a colorant (for example, see Japanese Patent Application Laid-Open Nos. 2001-175022 and 2003-91095), or a toner using a colorant such as white, yellow, or a light color. As a result, when normal image formation is carried out after finishing warm up, even if the dummy toner remains on the developing roller 23*a*, there is little influence thereof on the color reproducibility with respect to the image formed on the transfer material P, causing no problem in the image. Specifically, with respect to an image formed when the toner deposition amount in a toner image on the photosensitive drum 21 becomes 1.0 mg/cm$^2$, the reflection density measured by the "X-lite 938" manufactured by X-lite becomes equal to or less than 0.2 (at maximum, equal to or less than 0.4).

It is defined herein that the dummy toner carried on the new developing roller 23*a* is distinguished from the developer stored in the developing unit 23.

The "process cartridge" is obtained by integrally forming at least one of the charging unit, the developing unit, and the cleaning unit, and the image carrier (the photosensitive drum), and is detachably installed in the image forming apparatus main unit.

According to the third embodiment, the process cartridge 220 has the configuration such that the photosensitive drum 21, the charging unit 22, the developing unit 23, and the cleaning unit 25 are integrally held by the case 26. On the other hand, the configuration of the process cartridge, to which the present invention is applied, may be such that the process cartridge is formed of the photosensitive drum 21 and the developing unit 23. Further, the process cartridge may be formed of the photosensitive drum 21, the developing unit 23, and the charging unit 22 or the cleaning unit 25. Also in this case, the effects similar to those of the third embodiment can be obtained.

According to the third embodiment, the present invention is applied to an image forming apparatus in which the process cartridge 120 having the developing unit 23 is detachably installed. On the other hand, the present invention is also applicable to an image forming apparatus having a developing unit detachably and singly installed in the apparatus main unit 1, not in the configuration of the process cartridge. In this case, the toner T (one-component developer) is not stored in the new developing unit, as in the third embodiment, and a plurality of developing unites are commonly used. After a plurality of compatible developing unites are installed in a plurality of installation sections in the apparatus main unit, the toner T is supplied to the developing unit from the toner supply units of respective colors provided in the apparatus main unit. Even in the image forming apparatus having such a developing unit, the effects similar to those of the third embodiment can be obtained.

It is clear that the present invention is not limited to the first to the third embodiments, and the first to the third embodiments can be appropriately changed other than those indicated in the embodiments, without departing from the technical spirit of the present invention. Further, the number, the position, and the shape of the constituents are not limited to those shown in the embodiments, and any preferable number, position, and shape in implementing the present invention can be used.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus comprising:

a plurality of process cartridges that integrally holds an image carrier and a developing unit that develops an electrostatic latent image formed on the image carrier to form a toner image, the process cartridges being compatible with each other;

a plurality of installation sections in which the process cartridges are detachably installed, respectively;

a carrier and a dummy toner stored in the developing unit of each of the process cartridges in a brand-new status to be installed in the installation sections;

a plurality of toner supply units that supply a toner of one color from among a plurality of color toners, respectively, to the developing units of the process cartridges installed in the installation sections; and a transfer unit that transfers the toner image formed on the image carrier onto a medium to form an image, wherein the dummy toner is formed such that the dummy toner less contributes to formation of the image on the medium than the color toners, and each of the color toners is supplied to the developing unit from the toner supply units after the process cartridges in the brand new status are installed in the installation sections.

2. The image forming apparatus according to claim 1, wherein a part of or all the dummy toner is discharged from the developing unit, after the process cartridge in the brand new status is installed in the installation section.

3. The image forming apparatus according to claim 2, further comprising a toner density sensor that detects density of the toner image formed on the image carrier, wherein discharge of the dummy toner from the developing unit is controlled based on a result of detection of the toner density sensor.

4. The image forming apparatus according to claim 1, wherein at least one of a charging unit that charges the image carrier and a cleaning unit that cleans the image carrier is integrally held in the process cartridge.

5. The image forming apparatus according to claim 1, wherein the dummy toner is formed such that saturated charging amount of the dummy toner is smaller than that of the color toners.

6. The image forming apparatus according to claim 1, wherein the dummy toner is a transparent toner without containing a colorant.

7. The image forming apparatus according to claim 1, wherein the dummy toner contains a colorant of any one of white, yellow, and a color of reduced shade.

8. The image forming apparatus according to claim 1, wherein the dummy toner includes a binder resin, and the binder resin is formed so that the haze value in a dispersion liquid is 10% to 40%.

9. The image forming apparatus according to claim 1, wherein the dummy toner is formed by coating toner base particles with electroconductive fine particles.

10. The image forming apparatus according to claim 9, wherein the dummy toner is formed such that electrical resistance of the dummy toner is smaller than that of the color toners.

11. The image forming apparatus according to claim 1, wherein the dummy toner contains a lubricant.

12. The image forming apparatus according to claim 11, wherein the lubricant is a fatty acid metal salt.

13. The image forming apparatus according to claim 11, wherein the lubricant is fluororesin fine particles.

14. The image forming apparatus according to claim 11, wherein the lubricant is either of silicone oil and silicone varnish.

15. The image forming apparatus according to claim 1, wherein the carrier is formed such that true density is 1.5 $g/cm^3$ to 6.0 $g/cm^3$, weight average particle diameter is 15 micrometers to 60 micrometers, and shape factor SF2 is 100 to 150.

16. The image forming apparatus according to claim 1, wherein the carrier is a magnetically dispersed binder carrier.

17. The image forming apparatus according to claim 1, wherein the carrier is a coat carrier.

18. The image forming apparatus according to claim 17, wherein the coat carrier includes a coat layer containing fluororesin fine particles.

19. An image forming apparatus comprising:

a plurality of developing units that develops an electrostatic latent image formed on an image carrier to form a toner image, the developing units being compatible with each other;

a plurality of installation sections in which the developing units are detachably installed, respectively;

a carrier and a dummy toner stored in the developing unit of each of the process cartridges in a brand-new status to be installed in the installation sections;

a plurality of toner supply units that supply a toner of one color from among a plurality of color toners, respectively, to the developing units of the process cartridges installed in the installation sections; and a transfer unit that transfers the toner image formed on the image carrier onto a medium to form an image, wherein the dummy toner is formed such that the dummy toner less contributes to formation of the image on the medium than the color toners, and each of the color toners is supplied to the developing unit from the toner supply units after the process cartridges in the brand new status are installed in the installation sections.

20. The image forming apparatus according to claim 19, wherein a part of or all the dummy toner is discharged from the developing unit, after the developing unit in the brand new status is installed in the installation section.

21. The image forming apparatus according to claim 20, further comprising a toner density sensor that detects density of the toner image formed on the image carrier, wherein discharge of the dummy toner from the developing unit is controlled based on a result of detection of the toner density sensor.

22. The image forming apparatus according to claim 19, wherein the dummy toner is formed such that saturated charging amount of the dummy toner is smaller than that of the color toners.

23. The image forming apparatus according to claim 19, wherein the dummy toner is a transparent toner without containing a colorant.

24. The image forming apparatus according to claim 19, wherein the dummy toner contains a colorant of any one of white, yellow, and a color of reduced shade.

25. The image forming apparatus according to claim 19, wherein the dummy toner includes a binder resin, and the binder resin is formed so that the haze value in a dispersion liquid is 10% to 40%.

26. The image forming apparatus according to claim 19, wherein the dummy toner is formed by coating toner base particles with electroconductive fine particles.

27. The image forming apparatus according to claim 26, wherein the dummy toner is formed such that electrical resistance of the dummy toner is smaller than that of the color toners.

28. The image forming apparatus according to claim 19, wherein the dummy toner contains a lubricant.

29. The image forming apparatus according to claim 28, wherein the lubricant is a fatty acid metal salt.

30. The image forming apparatus according to claim 28, wherein the lubricant is fluororesin fine particles.

31. The image forming apparatus according to claim 28, wherein the lubricant is either of silicone oil and silicone varnish.

32. The image forming apparatus according to claim 19, wherein the carrier is formed such that true density is 1.5 $g/cm^3$ to 6.0 $g/cm^3$, weight average particle diameter is 15 micrometers to 60 micrometers, and shape factor SF2 is 100 to 150.

33. The image forming apparatus according to claim 19, wherein the carrier is a magnetically dispersed binder carrier.

34. The image forming apparatus according to claim 19, wherein the carrier is a coat carrier.

35. The image forming apparatus according to claim 34, wherein the coat carrier includes a coat layer containing fluororesin fine particles.

36. A process cartridge that integrally holds an image carrier and a developing unit that develops an electrostatic latent image formed on the image carrier to form a toner image, wherein in a brand new status, the developing unit does not store a toner capable of forming a toner image, and stores a carrier and a dummy toner inside, the dummy toner being different from toners forming the toner image.

37. The process cartridge according to claim 36, wherein at least one of a charging unit that charges the image carrier and a cleaning unit that cleans the image carrier is integrally held therein.

38. The process cartridge according to claim 36, wherein the process cartridge is formed such that it is detachable in any one of a plurality of installation sections in a main unit of an image forming apparatus, and in a status of being installed in the installation section, a toner of one color from among a plurality of color toners is supplied to the developing unit from one of a plurality of toner supply units in the main unit, the dummy toner is formed such that the dummy toner less contributes to formation of the image on the medium than the color toners, and each of the color toners is supplied to the developing units, respectively, after the process cartridge in the brand new status is installed in the installation section.

39. The process cartridge according to claim 38, wherein a part of or all the dummy toner is discharged from the developing unit, after the process cartridge in the brand new status is installed in the installation section.

40. The process cartridge according to claim 39, wherein the main unit includes a toner density sensor that detects density of the toner image formed on the image carrier, and discharge of the dummy toner from the developing unit is controlled based on a result of detection of the toner density sensor.

41. The process cartridge according to claim 36, wherein the dummy toner is formed such that saturated charging amount of the dummy toner is smaller than that of the color toners.

42. The process cartridge according to claim 36, wherein the dummy toner is a transparent toner without containing a colorant.

43. The process cartridge according to claim 36, wherein the dummy toner contains a colorant of any one of white, yellow, and a color of reduced shade.

44. The process cartridge according to claim 36, wherein the dummy toner includes a binder resin, and the binder resin is formed so that the haze value in a dispersion liquid is 10% to 40%.

45. The process cartridge according to claim 36, wherein the dummy toner is formed by coating toner base particles with electroconductive fine particles.

46. The process cartridge according to claim 45, wherein the dummy toner is formed such that electrical resistance of the dummy toner is smaller than that of the color toners.

47. The process cartridge according to any one of claim 36, wherein the dummy toner contains a lubricant.

48. The process cartridge according to claim 47, wherein the lubricant is a fatty acid metal salt.

49. The process cartridge according to claim 47, wherein the lubricant is fluororesin fine particles.

50. The process cartridge according to claim 47, wherein the lubricant is either of silicone oil and silicone varnish.

51. The process cartridge according to claim 36, wherein the carrier is formed such that true density is 1.5 $g/cm^3$ to 6.0 $g/cm^3$, weight average particle diameter is 15 micrometers to 60 micrometers, and shape factor SF2 is 100 to 150.

52. The process cartridge according to claim 36, wherein the carrier is a magnetically dispersed binder carrier.

53. The process cartridge according to claim 36, wherein the carrier is a coat carrier.

54. The process cartridge according to claim 53, wherein the coat carrier includes a coat layer containing fluororesin fine particles.

55. A developing unit that develops an electrostatic latent image formed on an image carrier to form a toner image, wherein in a brand new status, the developing unit does not store a toner capable of forming a toner image, and stores a carrier and a dummy toner inside, the dummy toner being different from toners forming the toner image.

56. The developing unit according to claim 55, wherein the process cartridge is formed such that it is detachable in any one of a plurality of installation sections in a main unit of an image forming apparatus, and in a status of being installed in the installation section, a toner of one color from among a plurality of color toners is supplied to the developing unit from one of a plurality of toner supply units in the main unit, the dummy toner is formed such that the dummy toner less contributes to formation of the image on the medium than the color toners, and each of the color toners is supplied to the developing units, respectively, after the process cartridge in the brand new status is installed in the installation section.

57. The developing unit according to claim 56, wherein a part of or all the dummy toner is discharged from the developing unit, after the process cartridge in the brand new status is installed in the installation section.

58. The developing unit according to claim 57, wherein the main unit includes a toner density sensor that detects density of the toner image formed on the image carrier, and discharge of the dummy toner from the developing unit is controlled based on a result of detection of the toner density sensor.

59. The developing unit according to claim 55, wherein the dummy toner is formed such that saturated charging amount of the dummy toner is smaller than that of the color toners.

60. The developing unit according to claim 55, wherein the dummy toner is a transparent toner without containing a colorant.

61. The developing unit according to claim 55, wherein the dummy toner contains a colorant of any one of white, yellow, and a color of reduced shade.

62. The developing unit according to claim 55, wherein the dummy toner includes a binder resin, and the binder resin is formed so that the haze value in a dispersion liquid is 10% to 40%.

63. The developing unit according to claim 55, wherein the dummy toner is formed by coating toner base particles with electroconductive fine particles.

64. The developing unit according to claim 63, wherein the dummy toner is formed such that electrical resistance of the dummy toner is smaller than that of the color toners.

65. The developing unit according to claim 55, wherein the dummy toner contains a lubricant.

66. The developing unit according to claim 65, wherein the lubricant is a fatty acid metal salt.

67. The developing unit according to claim 65, wherein the lubricant is fluororesin fine particles.

68. The developing unit according to claim 65, wherein the lubricant is either of silicone oil and silicone varnish.

69. The developing unit according to claim 55, wherein the carrier is formed such that true density is 1.5 g/cm$^3$ to 6.0 g/cm$^3$, weight average particle diameter is 15 micrometers to 60 micrometers, and shape factor SF2 is 100 to 150.

70. The developing unit according to claim 55, wherein the carrier is a magnetically dispersed binder carrier.

71. The developing unit according to claim 55, wherein the carrier is a coat carrier.

72. The developing unit according to claim 71, wherein the coat carrier includes a coat layer containing fluororesin fine particles.

73. An image forming method comprising:

installing a process cartridge that integrally holds an image carrier, and a developing unit that develops an electrostatic latent image formed on the image carrier to form a toner image, and stores a carrier and a dummy toner in the developing unit of the process cartridge in a brand new status, in one of a plurality of installation sections in a main unit of an image forming apparatus in which a plurality of process cartridges are detachably installed;

supplying a toner of one color from among a plurality of color toners to the developing unit from one of a plurality of toner supply units in the main unit, after the installing; and transferring the toner image formed on the image carrier onto a medium to form an image, wherein the dummy toner is formed such that the dummy toner less contributes to formation of the image on the medium than the color toners.

74. The image forming method according to claim 73, further comprising discharging a part of or all the dummy toner from the developing unit, after the installing.

75. The image forming method according to claim 74, further comprising detecting density of the toner image formed on the image carrier, wherein the discharging includes discharging the dummy toner based on a result of the detecting.

76. The image forming method according to claim 73, wherein at least one of a charging unit that charges the image carrier and a cleaning unit that cleans the image carrier is integrally held in the process cartridge.

77. The image forming method according to claim 73, wherein the dummy toner is formed such that saturated charging amount of the dummy toner is smaller than that of the color toners.

78. The image forming method according to claim 73, wherein the dummy toner is a transparent toner without containing a colorant.

79. The image forming method according to claim 73, wherein the dummy toner contains a colorant of any one of white, yellow, and a color of reduced shade.

80. The image forming method according to claim 73, wherein the dummy toner includes a binder resin, and the binder resin is formed so that the haze value in a dispersion liquid is 10% to 40%.

81. The image forming method according to claim 73, wherein the dummy toner is formed by coating toner base particles with electroconductive fine particles.

82. The image forming method according to claim 81, wherein the dummy toner is formed such that electrical resistance of the dummy toner is smaller than that of the color toners.

83. The image forming method according to claim 73, wherein the dummy toner contains a lubricant.

84. The image forming method according to claim 83, wherein the lubricant is a fatty acid metal salt.

85. The image forming method according to claim 83, wherein the lubricant is fluororesin fine particles.

86. The image forming method according to claim 83, wherein the lubricant is either of silicone oil and silicone varnish.

87. The image forming method according to claim 73, wherein the carrier is formed such that true density is 1.5 g/cm$^3$ to 6.0 g/cm$^3$, weight average particle diameter is 15 micrometers to 60 micrometers, and shape factor SF2 is 100 to 150.

88. The image forming method according to claim 73, wherein the carrier is a magnetically dispersed binder carrier.

89. The image forming method according to claim 73, wherein the carrier is a coat carrier.

90. The image forming method according to claim 89, wherein the coat carrier includes a coat layer containing fluororesin fine particles.

91. An image forming method comprising:

installing a developing unit that develops an electrostatic latent image formed on an image carrier to form a toner image, and stores a carrier and a dummy toner in a brand new status, in one of a plurality of installation sections in a main unit of an image forming apparatus in which a plurality of developing unites are detachably installed;

supplying a toner of one color from among a plurality of color toners to the developing unit from one of a plurality of toner supply units in the main unit, after the installing; and transferring the toner image formed on the image carrier onto a medium to form an image, wherein the dummy toner is formed such that the dummy toner less contributes to formation of the image on the medium than the color toners.

92. The image forming method according to claim 91, further comprising discharging a part of or all the dummy toner from the developing unit, after the installing.

93. The image forming method according to claim 92, further comprising detecting density of the toner image formed on the image carrier, wherein the discharging includes discharging the dummy toner based on a result of the detecting.

94. The image forming method according to claim 91, wherein the dummy toner is formed such that saturated charging amount of the dummy toner is smaller than that of the color toners.

95. The image forming method according to claim 91, wherein the dummy toner is a transparent toner without containing a colorant.

96. The image forming method according to claim 91, wherein the dummy toner contains a colorant of any one of white, yellow, and a color of reduced shade.

97. The image forming method according to claim 91, wherein the dummy toner includes a binder resin, and the binder resin is formed so that the haze value in a dispersion liquid is 10% to 40%.

98. The image forming method according to claim 91, wherein the dummy toner is formed by coating toner base particles with electroconductive fine particles.

99. The image forming method according to claim 98, wherein the dummy toner is formed such that electrical resistance of the dummy toner is smaller than that of the color toners.

100. The image forming method according to claim 91, wherein the dummy toner contains a lubricant.

101. The image forming method according to claim 100, wherein the lubricant is a fatty acid metal salt.

102. The image forming method according to claim 100, wherein the lubricant is fluororesin fine particles.

103. The image forming method according to claim 100, wherein the lubricant is either of silicone oil and silicone varnish.

104. The image forming method according to claim 91, wherein the carrier is formed such that true density is 1.5 $g/cm^3$ to 6.0 $g/cm^3$, weight average particle diameter is 15 micrometers to 60 micrometers, and shape factor SF2 is 100 to 150.

105. The image forming method according to claim 91, wherein the carrier is a magnetically dispersed binder carrier.

106. The image forming method according to claim 91, wherein the carrier is a coat carrier.

107. The image forming method according to claim 106, wherein the coat carrier includes a coat layer containing fluororesin fine particles.

108. An image forming method comprising:

installing a process cartridge that integrally holds an image carrier and a developing unit that develops an electrostatic latent image formed on the image carrier, and stores no developer in the process cartridge in a brand new status, in one of a plurality of installation sections in a main unit of an image forming apparatus in which a plurality of process cartridges are detachably installed; and supplying a toner of one color from among a plurality of color toners to the developing unit from one of a plurality of toner supply units in the main unit, after the installing.

109. The image forming method according to claim 108, wherein the developing unit includes a toner carrier that carries a toner supplied from the toner supply unit, and supplies the toner to the image carrier, and the process cartridges, in the brand new status, carry a dummy toner different from the color toners on the toner carrier.

110. The image forming method according to claim 109, wherein the dummy toner is a transparent toner without containing a colorant.

111. The image forming method according to claim 109, wherein the dummy toner contains a colorant of any one of white, yellow, and a color of reduced shade.

112. The image forming method according to claim 108, wherein the developing unit includes a toner carrier that carries a toner supplied from the toner supply unit, and supplies the toner to the image carrier, and the process cartridges, in the brand new status, carry a lubricant on the toner carrier.

113. The image forming method according to claim 112, wherein the lubricant is a fatty acid metal salt.

114. The image forming method according to claim 112, wherein the lubricant is fluororesin fine particles.

115. The image forming method according to claim 112, wherein the lubricant is either of silicone oil and silicone varnish.

116. The image forming method according to claim 108, wherein at least one of a charging unit that charges the image carrier and a cleaning unit that cleans the image carrier is integrally held therein.

117. The image forming method according to claim 108, wherein the color toners contain a lubricant.

118. The image forming method according to claim 117, wherein the lubricant is a fatty acid metal salt.

119. The image forming method according to claim 117, wherein the lubricant is fluororesin fine particles.

120. The image forming method according to claim 117, wherein the lubricant is either of silicone oil and silicone varnish.

* * * * *